US011859453B2

(12) United States Patent
Zilka

(10) Patent No.: US 11,859,453 B2
(45) Date of Patent: Jan. 2, 2024

(54) APPARATUS FOR MOUNTING ON A TUBULAR STRUCTURE

(71) Applicant: Friction Tool Solutions Inc., Red Deer (CA)

(72) Inventor: Kenneth John Zilka, Red Deer (CA)

(73) Assignee: Friction Tool Solutions Inc., Red Deer (CA)

( * ) Notice: Subject to any disclaimer, the term of this patent is extended or adjusted under 35 U.S.C. 154(b) by 503 days.

(21) Appl. No.: 16/903,081

(22) Filed: Jun. 16, 2020

(65) Prior Publication Data

US 2020/0308915 A1 Oct. 1, 2020

Related U.S. Application Data

(63) Continuation of application No. 15/573,554, filed as application No. PCT/CA2016/051531 on Dec. 22, 2016, now Pat. No. 10,718,169.

(60) Provisional application No. 62/387,280, filed on Dec. 23, 2015.

(51) Int. Cl.
*E21B 17/10* (2006.01)

(52) U.S. Cl.
CPC ..... *E21B 17/1064* (2013.01); *E21B 17/1078* (2013.01)

(58) Field of Classification Search
CPC ..... E21B 17/10–12; E21B 17/1064; E21B 17/1078
See application file for complete search history.

(56) References Cited

U.S. PATENT DOCUMENTS

| | | | |
|---|---|---|---|
| 4,984,633 | A | 1/1991 | Langer et al. |
| 5,797,455 | A | 8/1998 | Barron et al. |
| 6,830,102 | B2 | 12/2004 | Kirk et al. |
| 7,159,668 | B2 | 1/2007 | Herrera |
| 8,668,007 | B2 | 3/2014 | Casassa et al. |
| 2003/0010540 | A1 | 1/2003 | Kirk |

(Continued)

FOREIGN PATENT DOCUMENTS

| | | | |
|---|---|---|---|
| WO | 2013120192 | A1 | 8/2013 |
| WO | 2017106975 | A1 | 6/2017 |

OTHER PUBLICATIONS

International Search Report by the International Searching Authority for International application No. PCT/CA2016/051531 dated Mar. 21, 2017.

(Continued)

*Primary Examiner* — George S Gray
(74) *Attorney, Agent, or Firm* — AVEK IP, LLC; Kent R. Erickson

(57) ABSTRACT

An apparatus for mounting on a tubular structure, such as a casing or drill string having a longitudinal axis, that may reduce friction of the tubular structure in a horizontal or deviated well comprises a tubular segment for mounting over the casing or drill string such that the apparatus is freely rotatable about the longitudinal axis. The apparatus also includes a plurality of ridges on an outer face of the tubular segment, the ridges being at an angle to an axial direction of the tubular segment to cause the apparatus to rotate responsive to movement of the apparatus against a wall of a wellbore as the apparatus traverses the wellbore. The raised ridges have a non-uniform height from the outer face of the tubular segment.

25 Claims, 22 Drawing Sheets

(56) References Cited

U.S. PATENT DOCUMENTS

| | | | | |
|---|---|---|---|---|
| 2003/0106719 | A1 | 6/2003 | Herrera | |
| 2007/0215388 | A1* | 9/2007 | Kirk | E21B 17/1057 175/327 |
| 2008/0210419 | A1 | 9/2008 | Clark | |
| 2012/0073803 | A1 | 3/2012 | Dalmia | |
| 2013/0292183 | A1* | 11/2013 | Eidem | E21B 17/1057 175/325.5 |
| 2014/0158432 | A1* | 6/2014 | Simpson | E21B 7/04 175/73 |
| 2014/0262215 | A1 | 9/2014 | Hansen | |
| 2014/0311756 | A1 | 10/2014 | Dicke | |
| 2015/0275588 | A1 | 10/2015 | Trowbridge et al. | |
| 2015/0300100 | A1 | 10/2015 | Angman | |

OTHER PUBLICATIONS

Written Opinion of the International Searching Authority for International application No. PCT/CA2016/051531 dated Mar. 21, 2017.

* cited by examiner

APPARATUS FOR MOUNTING ON A TUBULAR STRUCTURE

RELATED APPLICATION

This application is a continuation of U.S. application Ser. No. 15/573,554, filed Nov. 13, 2017 that is a National Stage entry from PCT application PCT/CA2016/051531, filed Dec. 22, 2016 under 35 USC Section 371 that claims priority to U.S. Provisional Patent Application Ser. No. 62/387,280 filed Dec. 23, 2015, the entire contents of which are incorporated herein by reference.

FIELD OF THE DISCLOSURE

Aspects of the disclosure relate to tools for mounting on a tubular structure, such as a casing or drill string, that traverses a hole. More particularly, the disclosure relates to downhole tools for use in wells having a deviated section and/or a horizontal section.

BACKGROUND

In well operations, extending a horizontal and/or an otherwise deviated section of a wellbore can be an attractive way to increase production. A "build section" refers to a section of a wellbore that transitions between the vertical and horizontal sections of the wellbore. The build section and horizontal section of a well design may typically encounter problematic friction due to gravitational force applied on downhole tubular structures, such as a casing string or the drill string, against the wall of the wellbore. The friction may be increased as the tubular structure is extended within these sections of the wellbore. Such increases in problematic friction caused by the deviated and/or horizontal section can lead to challenges such as buckling, excess torque, etc.

SUMMARY

According to one aspect, there is provided an apparatus for mounting on a tubular structure for traversing a hole, the tubular structure having a longitudinal axis, the apparatus comprising: a tubular segment for mounting over the tubular structure such that the tubular segment is freely rotatable about the longitudinal axis, the tubular segment having an outer face that faces away from the tubular structure when mounted; a plurality of ridges on the outer face of the tubular segment, the ridges being spaced apart around a circumference of the tubular segment and angled with respect to an axial direction of the tubular segment to induce rotation of the apparatus responsive to movement of the apparatus against a wall of a hole as the apparatus traverses the hole; the ridges having non-uniform height from the outer face of the tubular segment.

In some embodiments, the non-uniform height of the ridges provide a non-circular end-view profile.

In some embodiments, the plurality of ridges are angled a same direction from an axial direction to induce said rotation.

In some embodiments, the ridges comprise helical or spiral ridges.

In some embodiments, the ridges collectively extend around an entire circumference of the tubular segment.

In some embodiments, the tubular segment has a first end and a second end opposite to the first end, and at least one of the ridges extend approximately from the first end to the second end.

In some embodiments, the ridges comprise: two side walls extending outward from the outer face of the tubular segment; and an outward facing surface between the two sidewalls.

In some embodiments, the outward facing surface of the ridges includes a recess or groove along at least a portion of a length of the ridge.

In some embodiments, the apparatus is formed of one or more materials suitable for use in at least one of: an oil well; and a gas well.

In some embodiments, the rotation of the apparatus and the non-uniform height of the ridges cause intermitted raising and lowering of the apparatus relative to the hole.

In some embodiments, the ridges each comprise a lower section and a raised section, the raised section having a greater height than the lower section.

In some embodiments, the ridges are spaced apart and arranged around the circumference of the tubular segment such that the ridges alternate between: the raised section being located at or near the first end of the tubular segment; and the raised section being located at or near the second end of the tubular segment.

In some embodiments, each said raised section extends along approximately one quarter to one half of the length of the tubular segment.

In some embodiments, a width of the ridge increases in a radial direction extending away from the outer face of the tubular segment.

In some embodiments, at least one ridge has an isosceles-trapezoid-shaped cross-sectional profile.

In some embodiments, the tubular segment defines an inner hole therethough with an inner diameter that is larger than the outer diameter of the tubular structure.

In some embodiments, the plurality of ridges comprises between four and eight ridges.

In some embodiments, each said ridge has respective first and second ends, the first and second ends of the ridges being bevelled.

In some embodiments, the apparatus comprises two or more portions that are couplable to form the tubular segment and the ridges thereon, the two or more portions also being decouplable.

In some embodiments, the two or more portions comprise a first semi-tubular portion and a second semi-tubular portion.

In some embodiments, the apparatus further comprises one or more clamps for coupling the first and second semi-tubular portions.

In some embodiments, the tubular structure is one of a casing string, a drill string, a coiled tubing string, a completions string, and a well servicing string.

In some embodiments, the tubular structure is a casing string, and the inner diameter is larger than the outer diameter of a casing section of the casing string, but smaller than the outer diameter of a casing section coupler.

In some embodiments, the hole is a wellbore.

According to another aspect, there is provided a method comprising: mounting the apparatus described herein on a tubular structure; traversing the hole with the tubular structure having the apparatus mounted thereon.

In some embodiments, the tubular structure comprises a section having an end, and mounting the apparatus on the tubular structure comprises placing the apparatus over the end of the section.

In some embodiments, the apparatus comprises two or more portions that are couplable to form the tubular segment and the ridges thereon, mounting the apparatus on the tubular structure comprises coupling the two or more portions about the tubular structure.

According to another aspect, there is provided an apparatus for mounting on a tubular structure for traversing a hole, the tubular structure having a longitudinal axis, the apparatus comprising: a tubular segment for mounting over the tubular structure such that the tubular segment is freely rotatable about the longitudinal axis, the tubular segment having an outer face that faces away from the tubular structure when mounted; a plurality of ridges on the outer face of the tubular segment, the ridges being spaced apart around a circumference of the tubular segment and angled a same direction with respect to an axial direction of the tubular segment; the ridges having non-uniform height from the outer face of the tubular segment.

Other aspects and features of the present disclosure will become apparent to those ordinarily skilled in the art, upon review of the following description of the specific embodiments of the disclosure.

BRIEF DESCRIPTION OF THE DRAWINGS

Some embodiments of the disclosure will now be described in greater detail with reference to the accompanying diagrams, in which.

DETAILED DESCRIPTION

Figure 1:
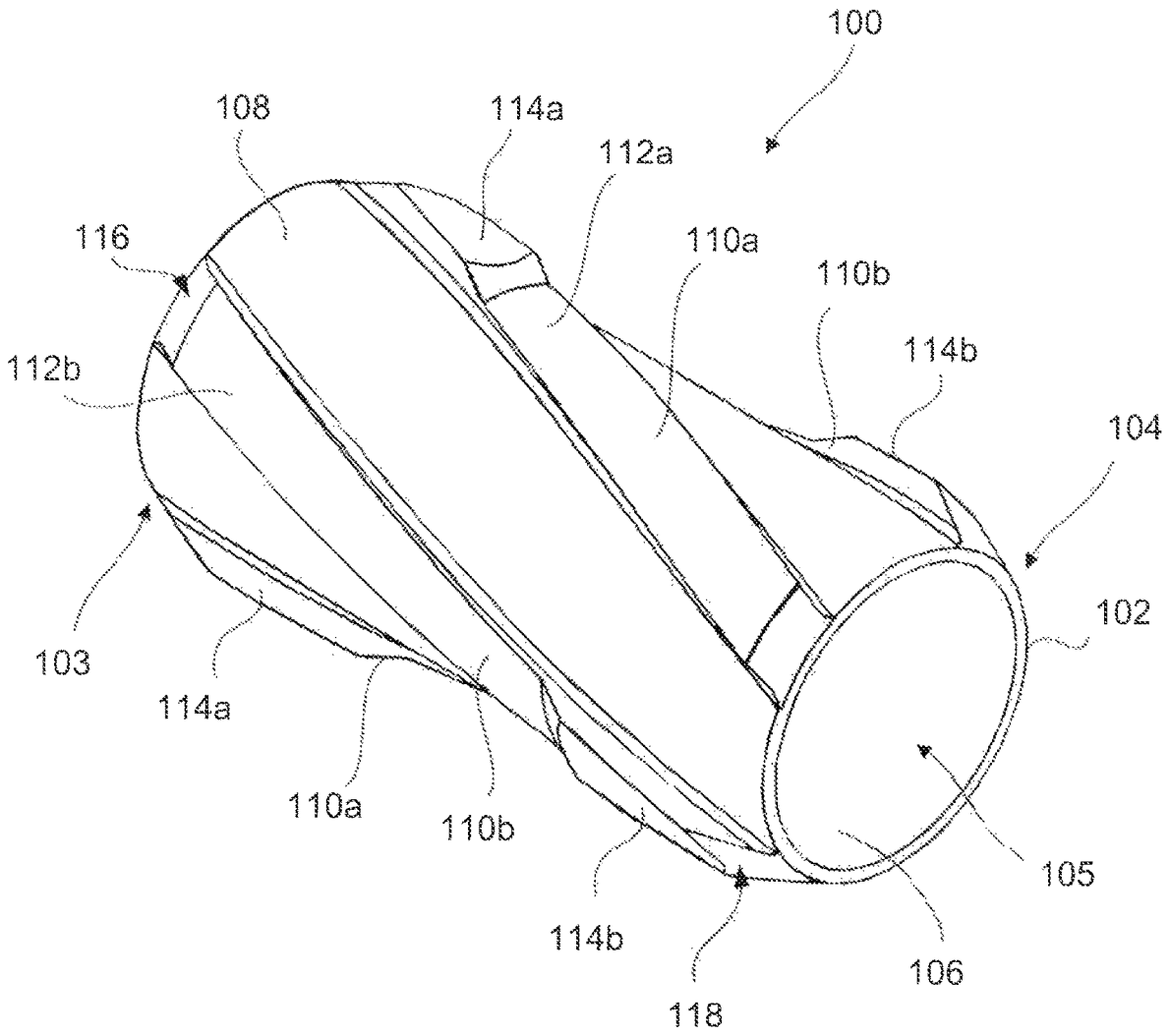
FIG. 1 is a perspective view of an apparatus for mounting on a tubular structure according to one embodiment.

According to some embodiments, an apparatus for mounting on a tubular structure that traverses a hole is provided. The tubular structure may, for example, be a pipe string such as a casing string or a drill string. The tubular structure may also be a coiled tubing structure, for example. The apparatus may be used in various downhole operations. The apparatus may rotate independently of the tubular structure. In some embodiments, the apparatus may comprise a plurality of directionally spiraled, offset, ridges having non-uniform heights. The ridges may induce the rotation. For example, the ridges may all be angled in a same direction from the axial direction. Thus, the ridges may collectively have a generally right or left-handed spiral-like orientation to induce the rotation responsive to friction between the apparatus and the wall of a hole (e.g. wellbore) as the apparatus traverses the hole. The ridges in some embodiments may also be referred to as "blades" herein.

The ridges may intermittently lift the tubular structure while the apparatus is rotating, thereby reducing or mitigating friction. The apparatus may be used, for example, in oil or gas well applications, although other applications are also possible. For example, the apparatus may be used for downhole applications including, but not limited to drilling, casing, well completion, cementing and well servicing applications, as well as various geothermal applications. Some embodiments described herein may be used in any application in which sections of pipe (i.e. a pipe string) or other tubular structure traverse a hole.

Some embodiments provide a method and apparatus for reducing and or preventing problematic friction between a tubular structure (e.g. casing or drill string or coiled tubing), and the walls of a hole, such as a wellbore. The apparatus may be particularly useful in the build section and the horizontal sections of a well design, although embodiments are not limited to use in these areas of a well. The apparatus, when mounted on a tubular structure, may be pushed along the hole (e.g. wellbore) by a coupling, stop collar, crossover (XO) sub, or other structure having a widened section. When pushed along the hole, the friction against the apparatus may cause the apparatus to rotate. Rotation of the apparatus may cause intermittent raising and lowering of the tubular structure and apparatus, thereby reducing friction between the tubular structure and the walls of the hole.

Some embodiments of the apparatus may harness friction created between the tubular structure (e.g. casing or drill string or coiled tubing) and the well bore to actuate or drive rotation of the apparatus to thereby reduce or minimize the friction. The apparatus may be installed over the outside diameter of the tubular structure (e.g. casing or pipe section), creating contact between the walls of the wellbore and the apparatus. Friction applied on the apparatus, through movement of the tubular structure in the hole, may drive rotation of the apparatus.

FIG. 1 is a perspective view of an apparatus 100 for mounting on a tubular structure (not shown) such as a casing or drill string, or coiled tubing. The apparatus 100 may, for example, be mounted over a pin end of a casing string (or other pipe string). A coupling between casing sections (not shown) may push the apparatus 100 through a wellbore. Alternatively, a stop collar (not shown) may be used to push the apparatus 100. The apparatus 100 may also be used on a drill string, for example, rather than a casing string. For installation on a drill string, a crossover (XO) sub (not shown) may be used to accommodate the apparatus 100. The apparatus 100 may be mounted on the XO sub on a drill string. The XO sub may match up to the threads of the chosen drill string. Embodiments described herein are not limited to use with casing strings, drill strings or coiled tubing. Embodiments may also be utilized with other types of tubular structures for traversing a hole (such as a wellbore or other narrow hole).

The apparatus 100 includes a tubular section or segment 102 for mounting over a tubular structure (such as a casing string section). In this example, the tubular segment 102 is sized for fitting over a casing section, but embodiments are not limited to use with casing, as discussed above.

The tubular segment 102 has a first end 103 and a second end 104 opposite to the first end 103. The inner diameter of the tubular segment 102 is larger than the outer diameter of the casing to which it is to be mounted, such that the apparatus 100 can freely or independently rotate about the casing. Specifically, in this example, the tubular segment 102 defines a hole 105 therethrough, and has an inner face 106 and an outer face 108. The hole 105 is thus sized to fit over the casing.

The inner diameter of the hole 105 may only be slightly larger than the outer diameter of the casing. Various embodiments of the apparatus may be sized to fit over various diameters of casings. Example casing diameters include, but are not limited to 4.5 inches, 5 inches, 20 inches, etc. The apparatus 100 may be placed over a pin end of a section of the casing at the drilling floor, for example. The apparatus 100 may then be lowered into the wellbore together with the section of the casing. The apparatus 100 may slide along the length of the casing until it is restricted and/or pushed by the couplings between casing sections, which typically have a greater diameter than the remainder of the casing. Alternatively, additional securing means, such as stop collars, may be placed at either end of the apparatus 100 to spot or secure the apparatus 100 to a particular lengthwise position on the casing section. Any suitable means of restricting movement of the apparatus 100 lengthwise along the casing (or other tubular structure) may be used.

The apparatus 100 includes a plurality of ridges 110*a* and 110*b* evenly spaced around a circumference of the outer face 108 of the tubular segment 102. The ridges 110*a* and 110*b* may be in the form of blades. The ridges 110*a* and 110*b* are angled with respect to the axial direction of the tubular segment 102, and as the apparatus 100 slides against the wall of a wellbore, the ridges 110*a* and 110*b* may rotate the apparatus 100 as the apparatus 100 is pushed through the hole. In other words, friction between the wellbore walls and the apparatus 100 drives rotation of the apparatus 100.

In this embodiment, the ridges 110*a* and 110*b* are helical or spiral, with a right-handed rotation (from the first end 103). The ridges 110*a* and 110*b* each extend approximately from the first end 103 to the second end 104 of the tubular segment 102. From the first end 103 to the second end 104 of the tubular segment, the ridges 110*a* and 110*b* each revolve around approximately one quarter of the circumference of the tubular segment 102. Thus, the four ridges 110*a* and 110*b* collectively extend around the entire circumference of the tubular segment 102. The angle and/or amount of spiraling of the ridges may vary in other embodiments.

The ridges 110*a* and 110*b* in FIG. 1 have a non-uniform height from the outer face 108. The ridges 110*a* and 110*b* each include a respective lower section 112*a* and 112*b* and a respective raised section 114*a* and 114*b*. The lower sections 112*a* and 112*b* extend a first distance from the outer face 108 of the tubular segment 102 (i.e. having a first height), and the raised sections 114*a* and 114*b* extend a second, greater distance from the outer face 108 (i.e. having a second, greater height). The ridges 110*a* and 110*b* are spaced around the circumference of the tubular segment 102 with alternating lengthwise orientations. The ridges 110*a* and 110*b* alternate between: the raised section 114*a* being located at or near the first end 103 of the tubular segment 102; and the raised section 114*b* being located at or near the second end 104 of the tubular segment 102. Thus, two of the ridges 110*a* have the raised section 114*a* at the first end 103 of the apparatus 100, and the other two ridges 110*b* have the raised section 114*b* at the second end 104.

The ridges 110*a* and 110*b* are equally spaced apart in this embodiment, although ridges may not be equally spaced apart in other embodiments.

In this embodiment, there are a total of four ridges 110*a* and 110*b*, although the number of ridges may vary. For example, tools with larger diameters may include more ridges than tools with smaller diameters. In another embodiment, the apparatus is adapted for use on a 5-inch casing and includes 4 ridges. In another embodiment, the apparatus is adapted for use on a 7-inch casing and includes 6 ridges. The number of ridges may be an even number so that the ridges can alternate in orientation similar to the ridges 110*a* and 110*b* shown in FIG. 1. Other combinations are also possible, and embodiments are not limited to a particular number or orientation of ridges for a particular casing diameter.

Each ridge 110*a* and 110*b* in this embodiment is chamfered or beveled at each of its ends 116 and 118 to the outer face 108 of the tubular segment 102, although this is optional. The chamfering at ends 116 and 118 of the ridges 110 may an angle of approximately 67.5 degrees with respect to the radial direction, although embodiments are not limited to any particular angle. The tubular segment 102 may be chamfered, and the chamfering of the ridges 110*a* and 110*b* may be flush with and/or have the same angle as the chamfering.

Figure 2:
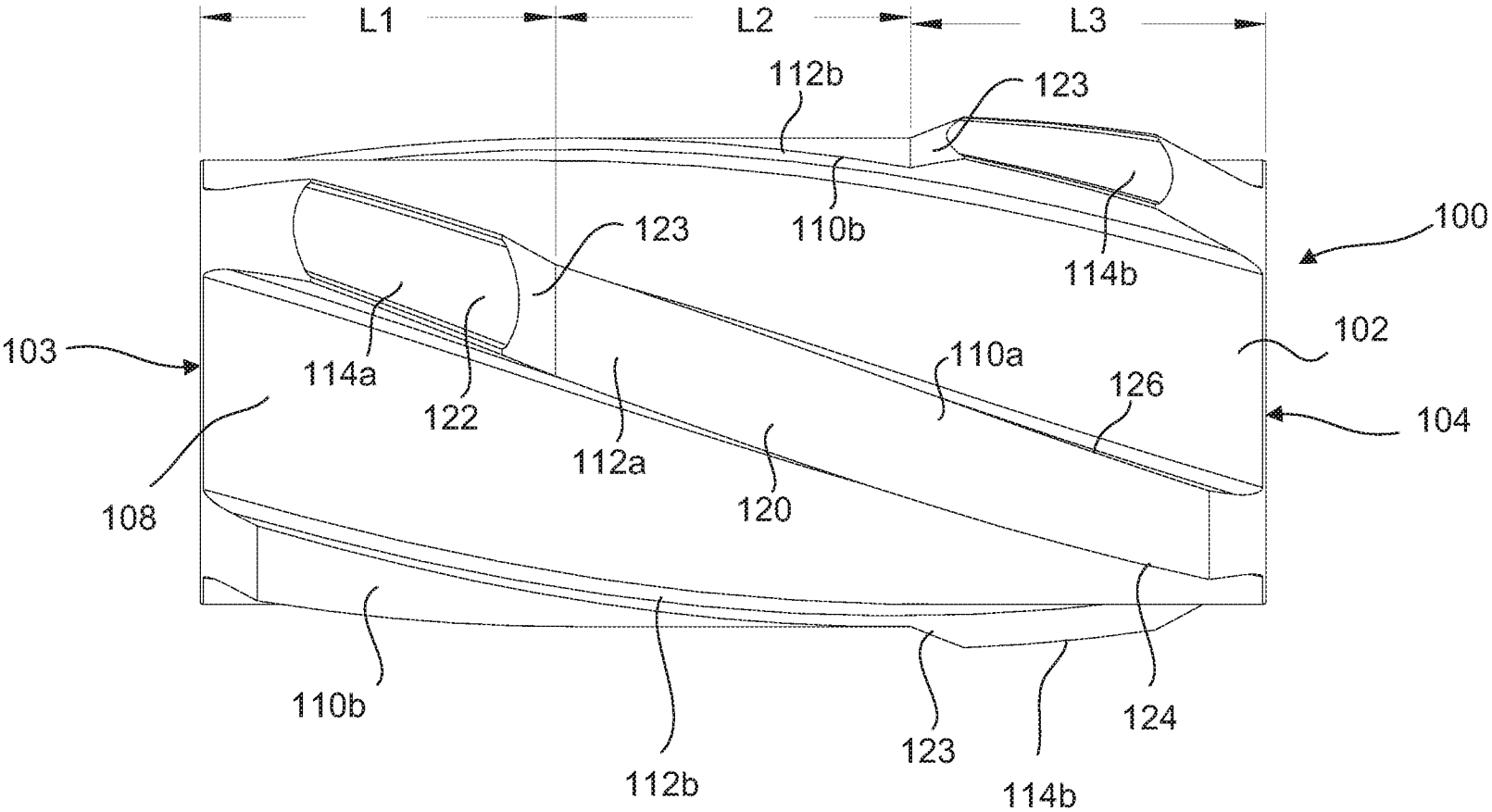
FIG. 2 is a side view of the apparatus of FIG. 1.

FIG. 2 is a side view of the apparatus 100 of FIG. 1. In this embodiment, the lengths "L1" is the axial length of the two raised sections 114*a* of the ridges 110*a* starting at the first end 103 of the tubular segment 102. The length "L3" is the axial length of the two raised sections 114*b* of the ridges 110*b* starting at the second end 104 of the tubular segment 102. Length "L2" is the distance between L1 and L3. Each of L1, L2 and L3 are approximately equal in this embodiment. Specifically, these lengths are each approximately 4 inches each in this example, giving a total length of 12 inches. However, the lengths L1, L2 and L3 shown in FIG. 2 may vary.

The ridges 110*a* and 110*b* have opposing side walls 124 and 126 that extend outward from outer face 108 of the tubular segment 102. The lower sections 112*a* and 112*b* of the ridges 110*a* and 110*b* each have a respective outward facing surface 120 (between side walls 124 and 126), and the raised sections 114*a* and 114*b* also each have a respective outward facing surface 122 (between side walls 124 and 126). The raised sections 114*a* and 114*b* also each include a short tapered surface 123 that tapers from the height of the raised sections 114*a* and 114*b* to the height of the lower sections 112*a* and 112*b*. The angle of the tapering between heights of the lower sections 112*a* and 112*b* and the raised sections 114*a* and 114*b* may match the angle of the chamfering at the ridge ends 116 and 118.

Embodiments are not limited to any particular shape of the ridges/blades. For example, the ridges could be blades in the form of narrow flanges, or the ridges may be wider than shown in FIGS. 1 and 2. The ridges may have various cross-sectional shapes (rectangular, triangular, etc.). Instead of continuous helical ridges along the length of the apparatus 100, other embodiments may include non-continuous ridges of varying lengths and configurations. For example, several short flanges, blades or other ridge-like structures may arranged at one or more angles to the axial direction and at various positions along the length of the tubular segment 102.

Figure 3:
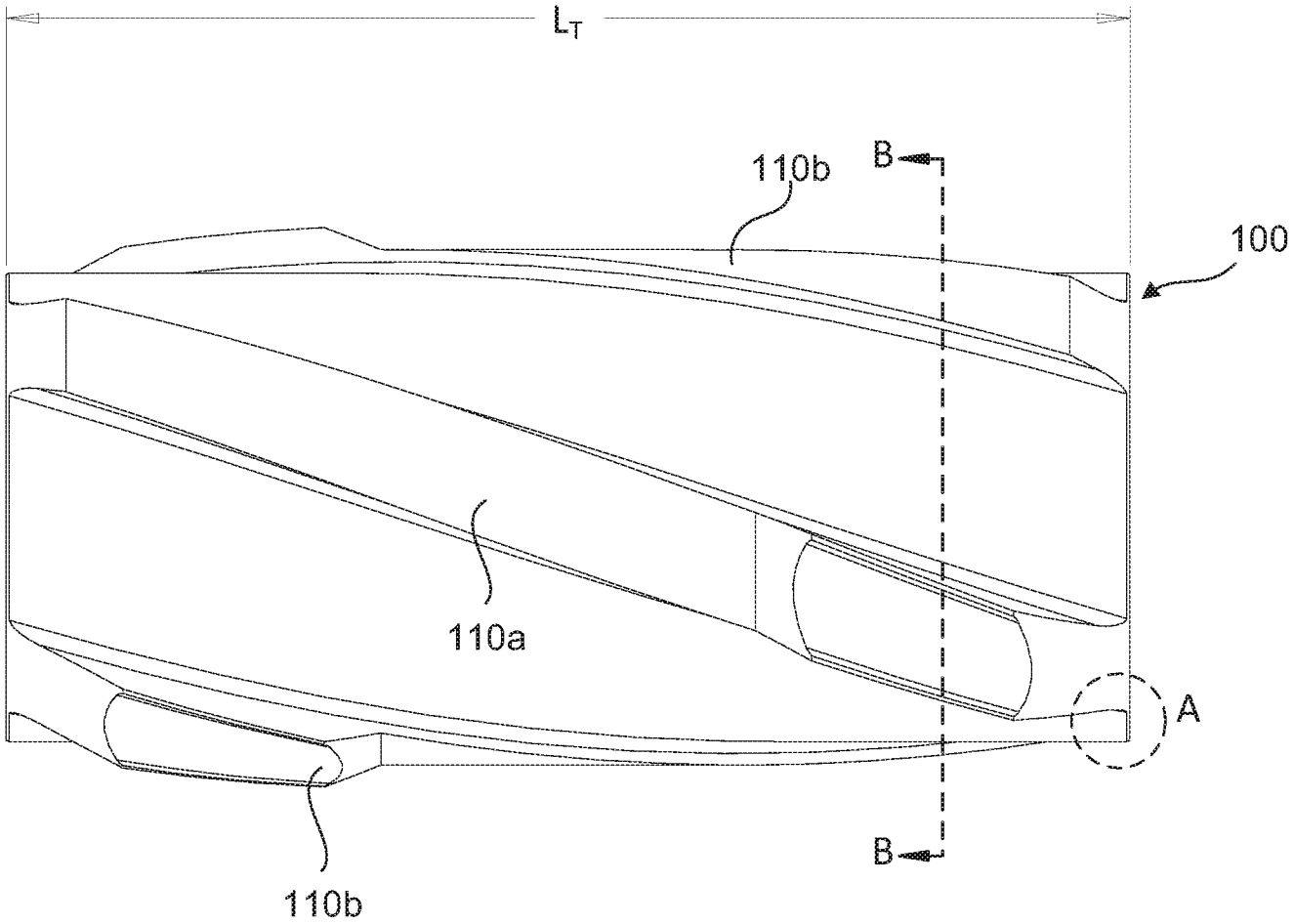
FIG. 3 is another side view of the apparatus of FIGS. 1 and 2.

FIG. 3 is a reverse side view of the apparatus 100 of FIGS. 1 and 2 showing the ridges 110*a* and 110*b* and indicating total length $L_T$, which is 12 inches in this example, although the length may vary.

Figure 4:
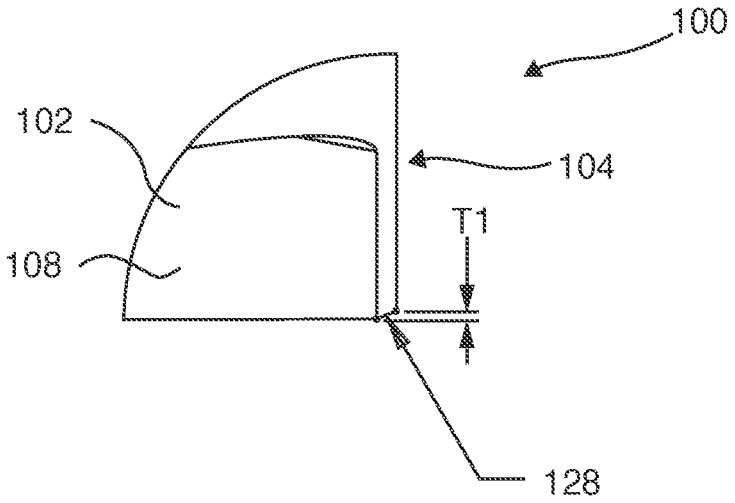
FIG. 4 is an enlarged partial side view of the apparatus of FIGS. 1 to 3, showing the portion within the circle "A" in FIG. 3.

FIG. 4 is an enlarged partial side view of the apparatus 100 showing only the portion within the circle "A" shown in FIG. 3. As shown in FIG. 4, the tubular segment 102 has a thickness T1 between the inner face 106 (shown in FIG. 1) and the outer face 108. The thickness T1 is approximately 0.22 inches in this example, although the thickness may vary in other embodiments. As shown in FIG. 4, the tubular segment 102 has an optional chamfer 128 between the outer face 108 and inner face 106 (shown in FIG. 1). The chamfer 128 is angled at approximately 68 degrees with respect to the radial direction of the tubular segment 102 (matching the chamfering of the ridges 110*a* and 110*b* (shown in FIGS. 1-3)), although this angle may vary. The optional chamfering or beveling may help avoid hang-up or snagging while the apparatus 100 travels through existing well components (e.g. a BOP (blow out preventer), surface casing, etc.) before the apparatus 100 reaches an open hole in the well bore.

Figure 5:
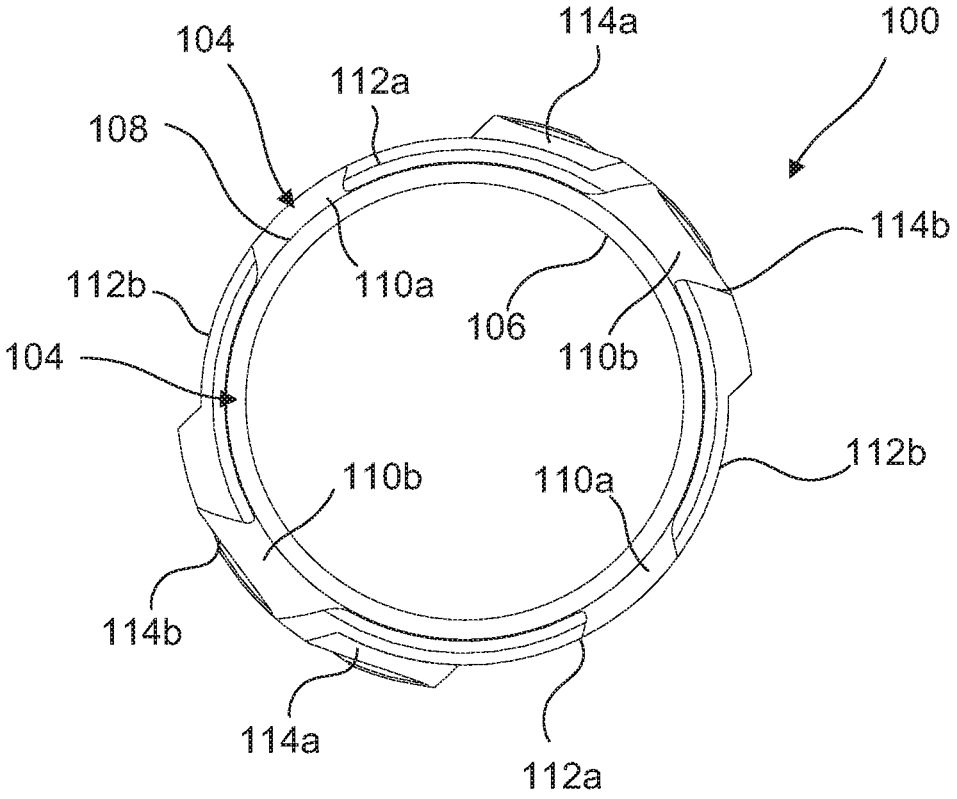
FIG. 5 is an end view of the apparatus of FIGS. 1 to 4.

FIG. 5 is an end view of the apparatus 100 viewed from the second end 104. FIG. 5 shows the ridges 110*a* and 110*b*, which are arranged in an alternating manner. The raised sections 114*b* of two ridges 110*b* are at the second end 104. The other two ridges 110*a* have their raised sections 114*a* at the first end 103 (shown in FIGS. 1 and 2). As seen in FIG. 5, the end-view, outer profile of the apparatus is non-circular and is closer to an elliptical shape, due to the alternating lengthwise orientation of the ridges 110*a* and 110*b*.

Figure 6:
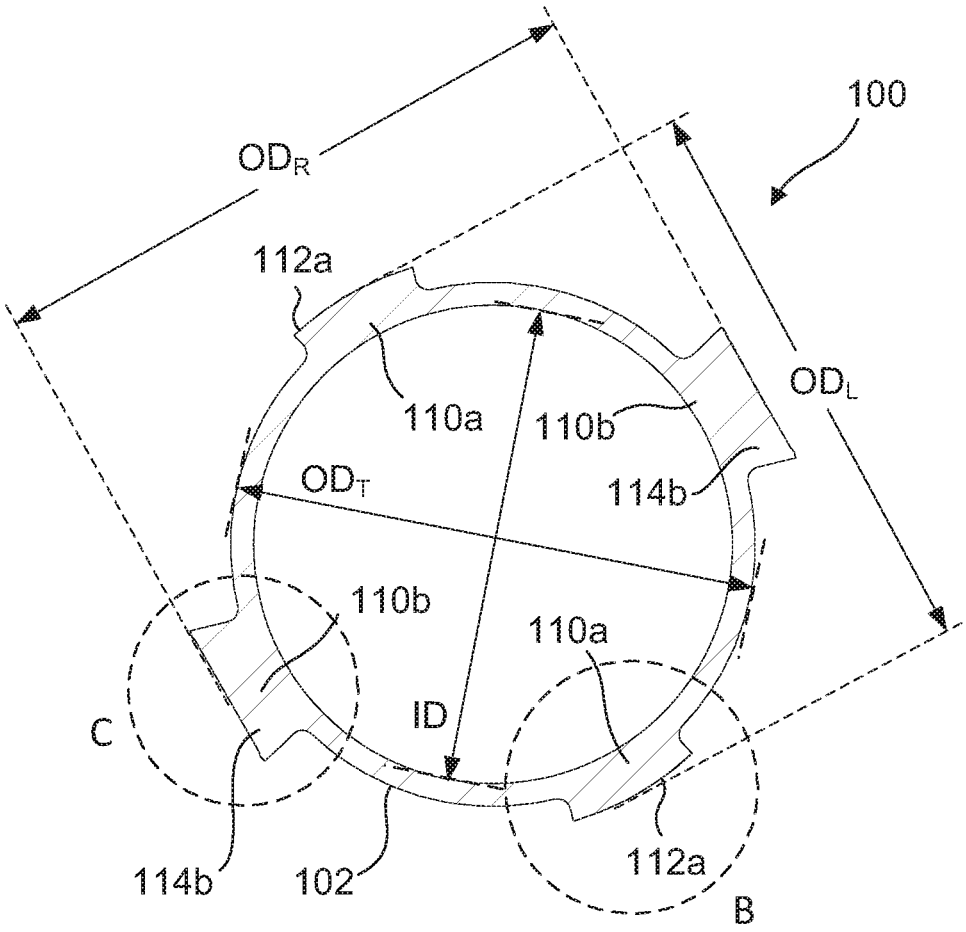
FIG. 6 is a cross-sectional view of the apparatus of FIGS. 1 to 5 taken along the line B-B shown in FIG. 3.

FIG. 6 is a cross-sectional view of the apparatus 100 taken along the line B-B shown in FIG. 3. FIG. 6 shows the lower sections 112*a* of two ridges 110*a* and the raised sections 114*b* of the other two ridges 110*b*. The inner diameter (ID) of the apparatus 100 is approximately 4.56 inches in this example. The outer diameter ($OD_T$) of the tubular segment 102 is approximately 5.0 inches in this example The outer diameter ($OD_R$) of the apparatus 100, at the raised portions 114*a* and 114*b* of the ridges 110*a* and 110*b*, is approximately 6 inches in this example. The outer diameter ($OD_L$) of the apparatus 100, at the lower portions 112*a* and 112*b* of the ridges 110*a* and 110*b*, is approximately 5.5 inches in this example. However, the dimensions of the apparatus 100 may vary in other embodiments depending on several factors including, but not limited to, casing diameter, wellbore diameter, well type, material composition of the apparatus 100, planned well operations and/or other factors. For example, the inner and outer diameters of the tubular segment 102 and the thickness of the tubular segment 102 may vary. The height, width, and shape of the ridges 110*a* and 110*b* may also vary.

As shown in FIG. 6, the entire apparatus 100 is a unitary structure in this example. For example, the downhole apparatus described herein may be formed by a molding process and/or by any other suitable manufacturing means. That apparatus may be formed of any material suitable for use in a well, such as an oil and/or gas well. Possible materials include, but are not limited to, polymer, steel or alloy and/or a composite of more than one material. For example, if the apparatus 100 is made of L80 grade steel, it may be suitable for sour gas service. However, embodiments are not limited to L80 grade steel. The apparatus 100 may also be formed from a lightweight resin. Embodiments are not limited to any particular material or combination of materials. Other embodiments described herein may likewise be made of any suitable material including, but not limited to the examples discuss above.

Embodiments are also not limited to the apparatus having a unitary structure. In other embodiments, the apparatus may be constructed of multiple materials and/or components. For example, the tubular segment could be formed separately from the ridges, and those two components could then be joined (e.g. using welding, adhesives, clamps, fastening hardware and/or other means). As one specific example, the tubular segment could be formed of metal, and metal ridges could be molded over the tubular segment.

Figure 8:
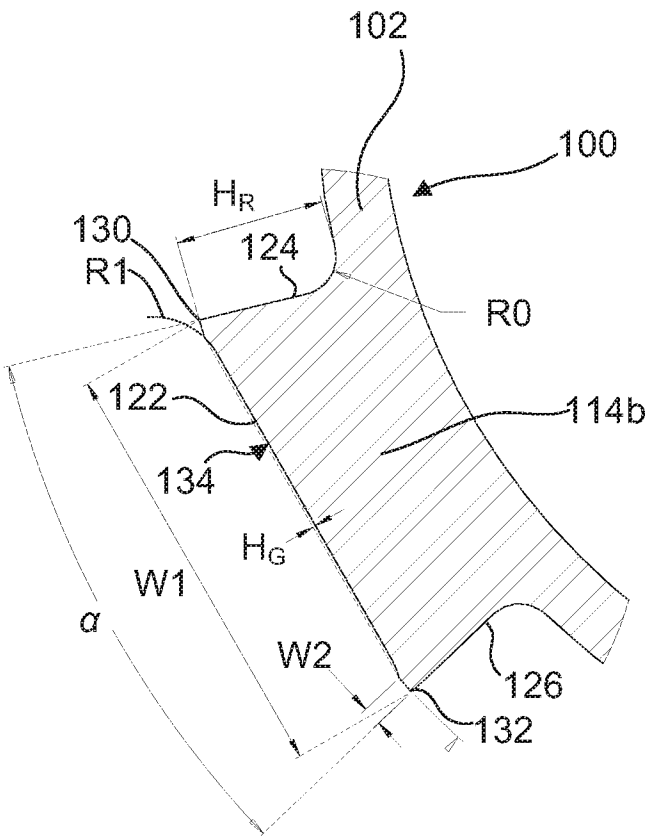
FIG. 8 is an enlarged partial view of the cross-section shown in FIG. 6, showing the portion of the apparatus within the circle "C" in FIG. 6.
Figure 7:
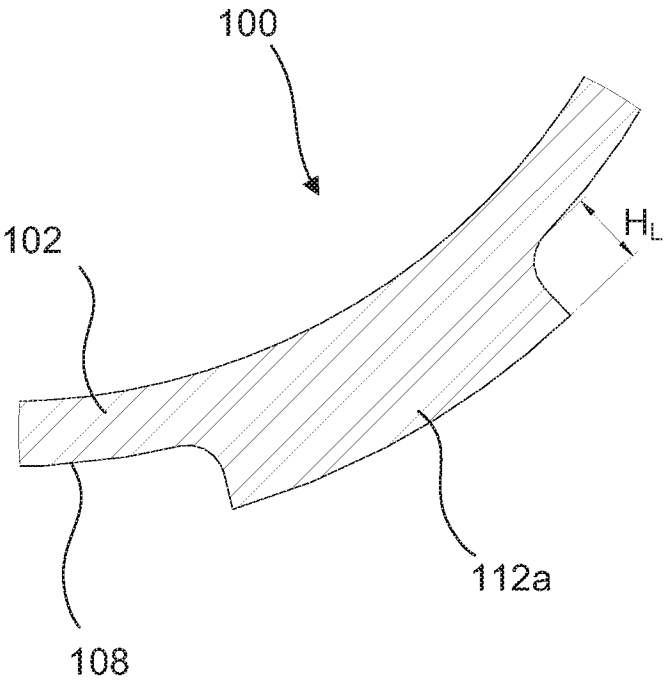
FIG. 7 is an enlarged partial view of the cross section shown in FIG. 6, showing the portion of the apparatus within the circle "B" in FIG. 6.

FIGS. 7 and 8 illustrate further details of the example lower sections 112*a* and 112*b* and raised sections 114*a* and 114*b* of the apparatus 100 in FIGS. 1 to 6.

FIG. 7 is an enlarged partial view of the cross section shown in FIG. 6, showing the portion within the circle "B" in FIG. 6. The lower section 112*a* extends a distance or height $H_L$ from the outer face 108 of the tubular segment 102 in the example of FIG. 7. Other lower sections 112*a* and 112*b* of the ridges 110*a* and 110*b* shown in FIGS. 1 3, 5 and 6 have similar dimensions. The height $H_L$ is about 0.25 inches in this example, but the height will vary in other embodiments.

FIG. 8 is an enlarged partial view of the cross-section shown in FIG. 6, showing the portion within the circle "C" in FIG. 6. The raised section 114*b* extends a distance or height $H_R$ from the outer face 108. In this example, $H_2$ is approximately 0.5 inches (although $H_R$ may vary in other embodiments).

As also shown in FIG. 8, the side walls 124 and 126 of the ridges 110*b* are angled with respect to each other, such that the ridge 110*b* flares outward as it extends away from the tubular segment 102. This flaring may provide a sharp, acute-angled side edges 130 and 132 between the outer facing surface 122 of the ridge 110*b* and the first and second side walls 124 and 126 respectively. The edges 130 and 132 may assist in driving rotation of the apparatus 100 because they may engage the wall of the wellbore more strongly or aggressively than softer edges (e.g. edges with 90 degree or wider angles and/or curved edges). In other words, the width of the ridge/blade increases in the outward direction from the tubular segment 102. Thus, as shown, the ridges 110*b* thus have a cross sectional profile similar to an isosceles trapezoid cross-sectional shape (with the outward facing surface 122 being the wide base).

The angle α between the first wall 124 and the second wall 126 of the raised section 114*b* is approximately 30 degrees in this example, although other angles may be used in other embodiments. The outer facing surface 122 of the raised section 114*b* in this example has a width W1 of approximately 1.43 inches. The first and second walls 124 and 126 of the raised section 114*b* transition to outer face 108 of the tubular segment 102 with a slight curve having a radius of curvature (R0) of approximately 0.125 inches. However, the curvature or angle of transitions between various surfaces or faces of the apparatus 100 may vary, for example based on the curvature of milling tools used to create either the apparatus 100 or a mold for forming the apparatus 100.

In some embodiments, the outward facing surfaces of the ridges (such as the outward facing surfaces 120 and 122 shown in FIG. 2) may define a slight groove (or other recessed or concave shape) along at least a portion thereof. The groove may, for example, be similar to the bottom surface of a hockey skate blade. For example, in the example of FIG. 8, the outward facing surface 122 of the raised section 114*b* forms a shallow groove 134 with a depth HG. The depth HG of the groove 134 is approximately 0.01 inches (although this may vary). The groove may have a substantially flat surface with curved sides/edges near the first and second side edges 130 and 132 of the raised section 114*b*. The sides of the groove in this example have an initial radius of curvature R1, which is approximately 0.25 inches (although this may vary). The curvature of the groove then softens between its sides to provide the 0.01-inch depth. The groove 134 in the outward facing surface 122 is almost as wide as the ridge 110*b*. The distance from the groove 134 to the first and second walls 124 and 126 is shown as width "W2" in FIG. 8. This width W2 is approximately 0.063 inches in this example (although this may vary). The groove 134 may further assist the ridges 110*a* and 110*b* to aggressively grip or engage the wall of the wellbore to more efficiently convert frictional force into rotation of the apparatus.

Raised sections 114*a* and 114*b* of the remaining ridges 110*a* and 110*b* shown in FIGS. 1 to 3, 5 and 6 have similar dimensions and structure as the raised section 114*b* shown in FIG. 8.

FIGS. 9A to 9D illustrate the operation of the apparatus 100 in a wellbore 150 according to some embodiments. FIGS. 9A to 9D each show an end view of the apparatus 100 and a cross-section of a casing 154 inside the apparatus 100. The wellbore 150 has wellbore wall 152. As the apparatus 100 moves with the casing through the wellbore 150, there is friction between the apparatus 100 and the wellbore wall 152. The wellbore is horizontal in FIGS. 9A to 9D with gravity pulling in the downward direction. As described above, in a build section or a horizontal section of a well, this friction can become problematic. However, the apparatus 100 may reduce overall friction as explained below. The friction of the wellbore wall 152 against the ridges 110*a* and 110*b* may cause the apparatus to repeatedly rotate through the positions shown in FIGS. 9A to 9D as it traverses the wellbore. The non-circular (elliptical in this case) end-view profile of the apparatus 100 may cause intermittent lifting and lowering of the apparatus as it rotates.

Figure 9B:
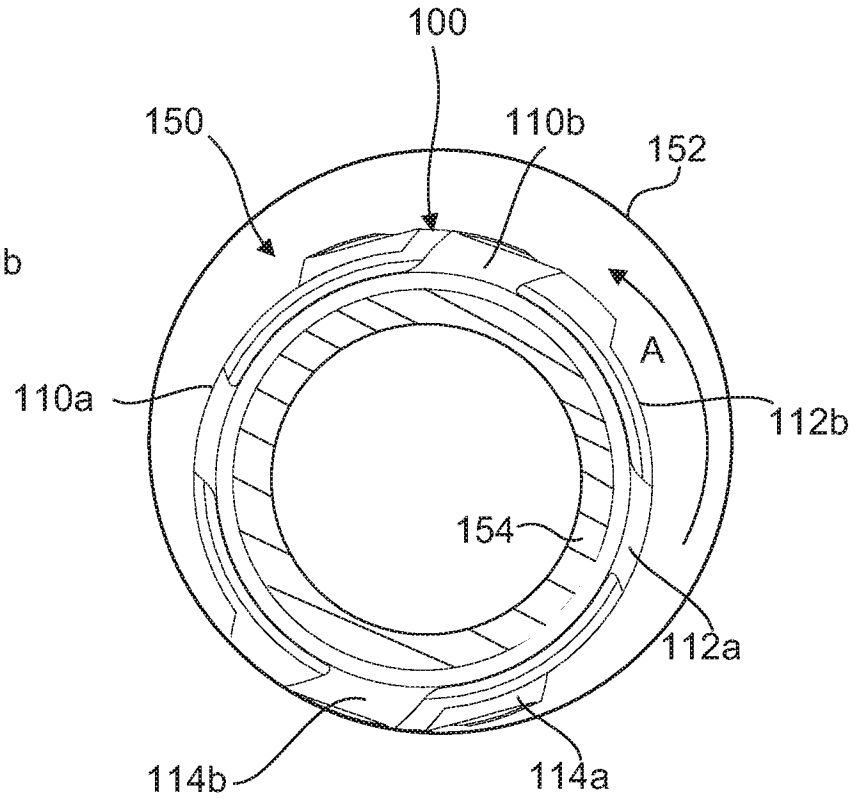
FIGS. 9A to 9D are end views of the apparatus of FIGS. 1 to 8 within a wellbore and mounted on a casing section.
Figure 9A:
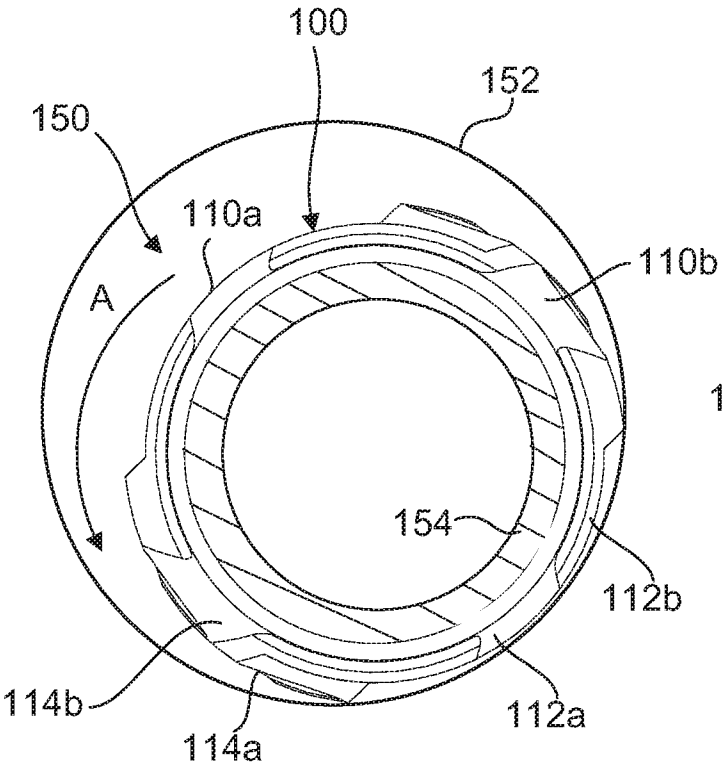
Figure 9D:
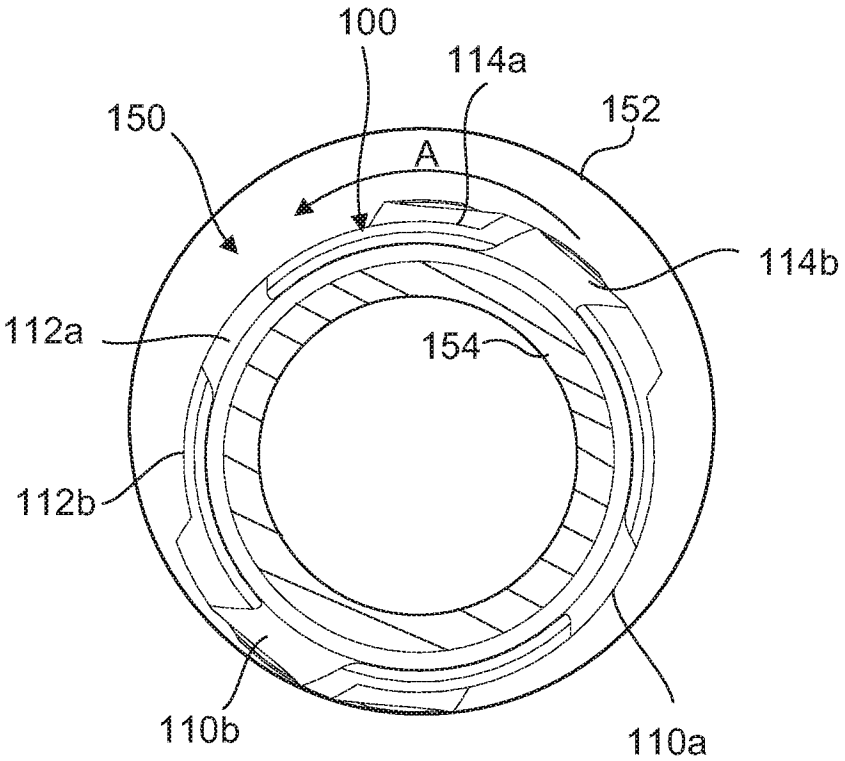
Figure 9C:
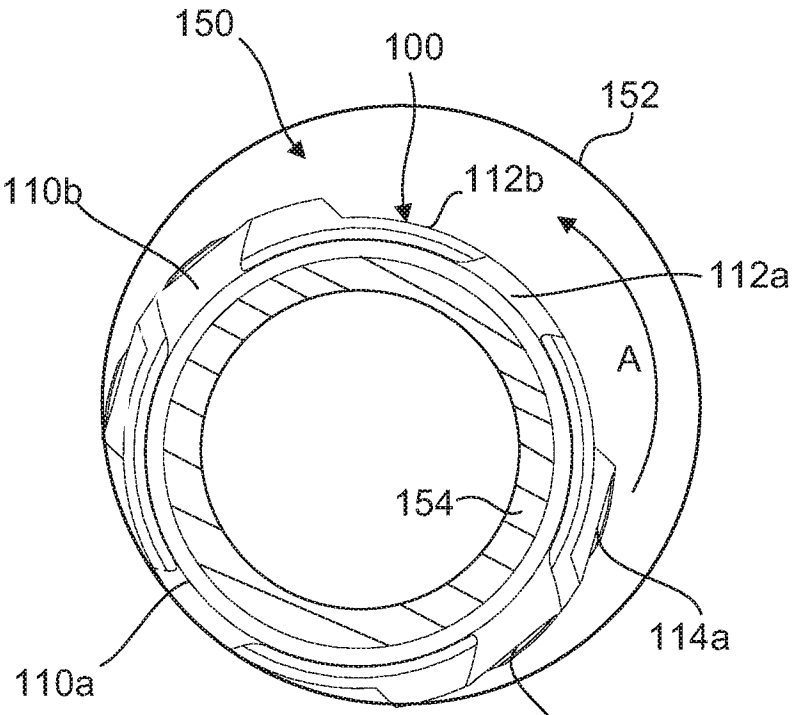

In FIGS. 9A to 9D, the rotation is in the counter clockwise direction as indicated by Arrow "A". Starting from FIG. 9A, the apparatus rotates such that the raised sections 114*a* and 114*b* rotate against the wall 152 of the wellbore 150, the increased thickness of the raised sections 114*a* and 114*b* raises the casing 154 away from the wellbore wall 152 for those portions of the rotation. The lower sections 112*a* and 112*b* of the ridges 110*a* and 110*b* may temporarily not be in contact with the wellbore wall 152 as shown in FIG. 9B. As the apparatus continues to rotate to the position of FIG. 9C, lower sections 112*a* and 112*b* may fall against the wall 152, thus lowering the casing 154. The rotation continues through the position shown in FIG. 9D, and the rotation may continue to repeat as long as the casing 154 and apparatus 100 traverse the wellbore.

Thus, the rotation and non-circular design of the apparatus's ellipse design may create an intermittent lifting motion, interrupting the problematic friction between the walls of the well bore and the casing or drill string as it is extended and moves within the well bore. Such an intermittent lifting motion on the casing or drill string may reduce and/or prevent at least some problematic friction throughout operations of drilling the well bore, and/or running the casing string in the build and horizontal sections of the well bore, for example.

Some embodiments of the apparatus described herein (such as apparatus 100 shown in FIGS. 1 to 8) may, for example, provide over 8 rotations per minute (rpm) for a run speed of 32.08 feet/min (approx. 10 meters/min) movement of the apparatus through the wellbore. For a run speed of 66 feet/min (approx. 20 meters/min) through the wellbore, rotation of the apparatus 100 could possibly be approximately 16 rpm or more. For a run speed of 98 feet/min (approx. 30 meters/min) through the wellbore, rotation of the apparatus 100 could possibly be approximately 24 rpm. For a run speed of 164 feet/min (approx. 50 meters/min) through the wellbore, rotation of the apparatus 100 could possibly be approximately 41 rpm. However, embodiments are not limited to any particular rotation speed or to any particular ratio of rotation speed to movement through the wellbore.

Fluids circulated in the wellbore may flow between adjacent ridges 110*a* and 110*b* (as well as in available space between the apparatus 100 and the wellbore wall). Thus, the apparatus 100, mud, cement and other fluids that may be circulated around the casing (or other tubular structure) may not be substantially impeded by the apparatus 100.

Embodiments are not limited to the shape or structure of the example ridges 110*a* and 110*b* described above. Other configurations are also possible. For example, in other embodiments, the ridges may have two ends with differing heights (one high, one low) and the outward facing surface of the ridges may taper along most or the entire length of the ridges between those two heights. The heights of such ridges may also be arranged in a lengthwise alternating manner similar to the other embodiments described herein. In other words, a first ridge/blade may have a raised point at or near a first end of the tubular core, while the next ridge/blade adjacent to the first blade has its raised point at or near the opposite second end of the tubular core. The arrangement of the ridges/blades may continue to alternate in such fashion. This alternating arrangement may result in a somewhat elliptical (non-circular) shape when viewing the apparatus at an end along the axial direction of the tubular core. When the apparatus is rotating around a center axis of the tubular core, the rotating ellipse shape may result in an intermittent lifting effect.

The number of ridges/blades included in the apparatus may vary based on the diameter of the tubular structure to which it is intended to be mounted (e.g. casing or drill string, XO sub, coiled tubing, etc.

The angle at which the ridges/blades spiral around the tubular core may vary depending on various factors, such as the length of the apparatus, the number of ridges, the inner and/or outer diameter of the apparatus, and/or the outer diameter of the ridges.

The ridges/blades are not limited to a certain length, and may vary at least based on the spiral angle and the diameter size of the tubular structure for which a particular apparatus is intended.

The height of the ridges/blades may vary, and embodiments are not limited to any particular height. For example, dimensions of the tubular core and the ridges/blades may be chosen to accommodate the diameter of the well bore for which the apparatus is intended.

The number of ridges/blades in contact with the wall of the wellbore during rotation may vary according to the design of the apparatus. For example, in FIGS. 9A to 9D, the apparatus 100 is shown with a design where two adjacent ridges/blades 110*a* and 110*b* together create lift because two raised sections 114*a* and 114*b* of the two ridges/blades are near the same point on the circumference of the tubular segment 102. However, ridges/blades may include more than one raised section and/or the raised sections may be arranged so that only one, or more than two ridges/blades together provides lift as the device rotates. Embodiments are not limited to a particular number of ridges/blades being in contact with the wall(s) of the well bore during rotation. In the example, shown in FIGS. 9A to 9B with four ridges 110*a* and 110*b*, the casing is either lifted or lowered every 90 degrees of rotation of the apparatus 100. With a greater number of ridges, the amount of rotation between lifting/lowering may be reduced. For example, for embodiments with six ridges, the lifting/lowering change may occur with every 60 degrees of rotation. For eight ridges, the lifting/lowering change may occur every 45 degrees of rotation. Other arrangements are also possible.

Various example dimensions of an apparatus according to some embodiments are provided below. The outer diameter of the tubular segment and the inner diameter of the tubular segment may vary. For example, the outer diameter of the tubular segment of the apparatus may be in range of 2 inches to about 19 inches or more. The inner diameter may be in the range of about 1.5 inches to 18.5 inches or more. The thickness of the tubular segment may, for example, be in the range of approximately 0.2 to 0.5 inches. The total length of the tubular segment may be in the range of 6 to 24 inches or more. The length of the raised portions of the ridges (e.g. length L1 or L3 in FIG. 2) may be in the range of 1 inches to 8 inches. It is to be understood that the ranges provided above are by way of example and embodiments are not limited to these ranges.

The dimensions of the ridges or blades on the tubular segment may also vary. For example, height of the ridges at their lower sections (e.g. height $H_L$ in FIG. 7) may be in the range of 0.25 to 1.5 inches or more. The height of the ridges at their raised sections (e.g. height $H_R$ in FIG. 8) may be in the range of 0.1 to 1.5 inches or more. The width of the ridges (e.g. width W1 in FIG. 8) may be in the range of approximately 0.5 inches to 3.5 inches or more. It is to be understood that the ranges provided above are by way of example and embodiments are not limited to these ranges.

Table 1 below shows several examples of approximate dimensions for tubular segments and the ridges/blades thereon according to some embodiments. It is to be understood that embodiments are not limited to these specific examples. In Table 1, "Tube Inner Diameter" refers to the inner diameter of the tubular segment. "Tube Outer Diameter" refers to the outer diameter of the tubular segment. "Ridge Outer Diameter" refers to the total outer diameter of the apparatus including the raised sections of the ridges. "Tube Length" refers to the entire length of the tubular segment. "Raised Section Length" refers to the length of the raised sections of the ridges, taken from the adjacent end of the apparatus (e.g. L1 and L3 in FIG. 2). "Ridge Height (raised)" refers to the height of the raised sections of the ridges. "Ridge Height (lower)" refers to the height of the lower sections of the ridges. "Ridge Width" refers to the width of the ridges (e.g. W1 in FIG. 8). The heading "#Ridge" refers to the number of ridges on the tubular segment. All of the values provided in Table 1 are in inches.

TABLE 1

| | Tube Inner Diameter (in) | Tube Outer Diameter (in) | Ridge Outer Diam. (in) | Tube Length (in) | Raised Section Length (in) | Ridge Height (raised) (in) | Ridge Height (lower) (in) | Ridge Width (in) | # of Ridge |
|---|---|---|---|---|---|---|---|---|---|
| Example 1 | 4.6 | 5.0 | 6.0 | 12.0 | 4.00 | 0.50 | 0.25 | 1.44 | 4 |
| Example 2 | 4.6 | 5.0 | 6.0 | 17.0 | 6.50 | 0.50 | 0.25 | 1.44 | 4 |
| Example 3 | 4.6 | 5.0 | 6.0 | 24.0 | 8.00 | 0.50 | 0.25 | 1.44 | 4 |
| Example 4 | 4.6 | 5.0 | 6.0 | 12.0 | 4.15 | 0.50 | 0.44 | 1.44 | 4 |
| Example 5 | 5.1 | 5.5 | 6.5 | 12.0 | 4.15 | 0.50 | 0.44 | 1.69 | 4 |
| Example 6 | 5.6 | 6.1 | 7.3 | 12.0 | 4.15 | 0.60 | 0.54 | 1.88 | 4 |
| Example 7 | 5.6 | 6.1 | 8.3 | 12.0 | 4.00 | 0.48 | 0.23 | 1.70 | 4 |
| Example 8 | 5.6 | 6.1 | 7.0 | 12.0 | 4.00 | 0.48 | 0.42 | 1.70 | 4 |
| Example 9 | 5.6 | 6.1 | 7.3 | 12.0 | 4.25 | 1.10 | 0.48 | 2.02 | 4 |
| Example 10 | 5.6 | 6.1 | 8.3 | 12.0 | 4.00 | 0.60 | 0.25 | 1.45 | 6 |
| Example 11 | 6.1 | 6.5 | 8.3 | 12.0 | 4.15 | 0.85 | 0.79 | 2.14 | 4 |
| Example 12 | 6.1 | 6.5 | 8.3 | 12.0 | 4.00 | 0.86 | 0.36 | 2.14 | 4 |
| Example 13 | 6.7 | 7.4 | 9.0 | 12.0 | 4.00 | 0.80 | 0.18 | 1.72 | 6 |
| Example 14 | 6.7 | 7.4 | 8.3 | 12.0 | 4.00 | 0.43 | 0.05 | 1.72 | 4 |
| Example 15 | 6.7 | 7.4 | 9.0 | 12.0 | 4.15 | 0.80 | 0.74 | 1.72 | 6 |
| Example 16 | 6.7 | 7.4 | 8.3 | 12.0 | 4.00 | 0.43 | 0.37 | 2.14 | 4 |
| Example 17 | 7.1 | 7.7 | 8.4 | 12.0 | 4.00 | 0.42 | 0.17 | 1.50 | 6 |
| Example 18 | 7.1 | 7.7 | 8.5 | 12.0 | 4.00 | 0.36 | 0.11 | 1.48 | 6 |

TABLE 1-continued

| | Tube Inner Diameter (in) | Tube Outer Diameter (in) | Ridge Outer Diam. (in) | Tube Length (in) | Raised Section Length (in) | Ridge Height (raised) (in) | Ridge Height (lower) (in) | Ridge Width (in) | # of Ridge |
|---|---|---|---|---|---|---|---|---|---|
| Example 19 | 7.1 | 7.7 | 8.4 | 12.0 | 4.15 | 0.36 | 0.30 | 1.48 | 6 |
| Example 20 | 7.7 | 8.5 | 9.5 | 12.0 | 4.00 | 0.50 | 0.25 | 1.70 | 6 |
| Example 21 | 7.7 | 8.5 | 9.5 | 12.0 | 4.15 | 0.50 | 0.48 | 1.69 | 6 |
| Example 22 | 8.7 | 9.6 | 10.5 | 12.0 | 4.00 | 0.44 | 0.19 | 2.01 | 6 |
| Example 23 | 8.7 | 9.6 | 10.5 | 12.0 | 4.10 | 0.45 | 0.39 | 2.01 | 6 |
| Example 24 | 9.7 | 10.6 | 12.0 | 12.0 | 4.00 | 0.69 | 0.31 | 1.57 | 6 |
| Example 25 | 9.7 | 10.6 | 12.0 | 12.0 | 4.00 | 0.69 | 0.63 | 1.57 | 8 |
| Example 26 | 10.8 | 12.3 | 14.8 | 16.0 | 6.00 | 1.25 | 1.18 | 1.93 | 8 |
| Example 27 | 11.8 | 12.8 | 14.8 | 16.0 | 6.00 | 1.00 | 0.94 | 1.93 | 8 |
| Example 28 | 13.5 | 14.4 | 17.3 | 16.0 | 6.00 | 1.44 | 1.38 | 2.25 | 8 |
| Example 29 | 16.1 | 17.0 | 19.8 | 16.0 | 6.00 | 1.38 | 1.31 | 2.58 | 8 |
| Example 30 | 18.7 | 19.70 | 23.5 | 16.0 | 6.00 | 1.90 | 1.83 | 3.00 | 8 |
| Example 31 | 20.1 | 21.08 | 23.5 | 16.0 | 6.00 | 1.15 | 1.09 | 3.07 | 8 |
| Example 32 | 1.5 | 2.0 | 3.5 | 6.0 | 1.50 | 0.75 | 0.25 | 0.75 | 4 |

Figure 10:
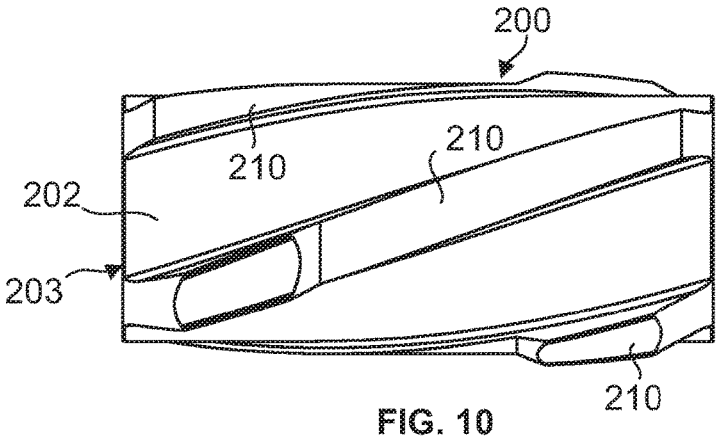
FIG. 10 is a side view of an example apparatus according to another embodiment.

Other variations are also possible. For example, the ridges may spiral in a left-handed or right-handed direction. FIG. 10 is a side view of an example apparatus 200 for mounting on a tubular structure (e.g. casing, drill string and/or tubular coil) according to another embodiment. The apparatus 200 comprises a tubular segment 202 and four ridges 210 thereon (similar to the apparatus 100 in FIGS. 1 to 8). However, the ridges 210 of the apparatus 200 in FIG. 10 spiral in a left-handed direction (rather than right-handed) from a first end 203. The direction of the spiraling may be chosen based on the desired rotational direction of the tools, and may also be based on a direction of rotation (if any) of the tubular structure on which the apparatus will be mounted.

Figure 11:
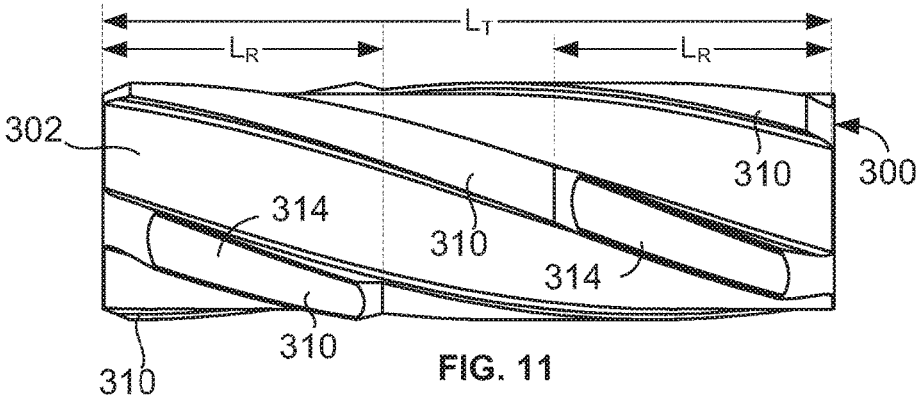
FIG. 11 is a side view of an example apparatus according to yet another embodiment.
Figure 12:
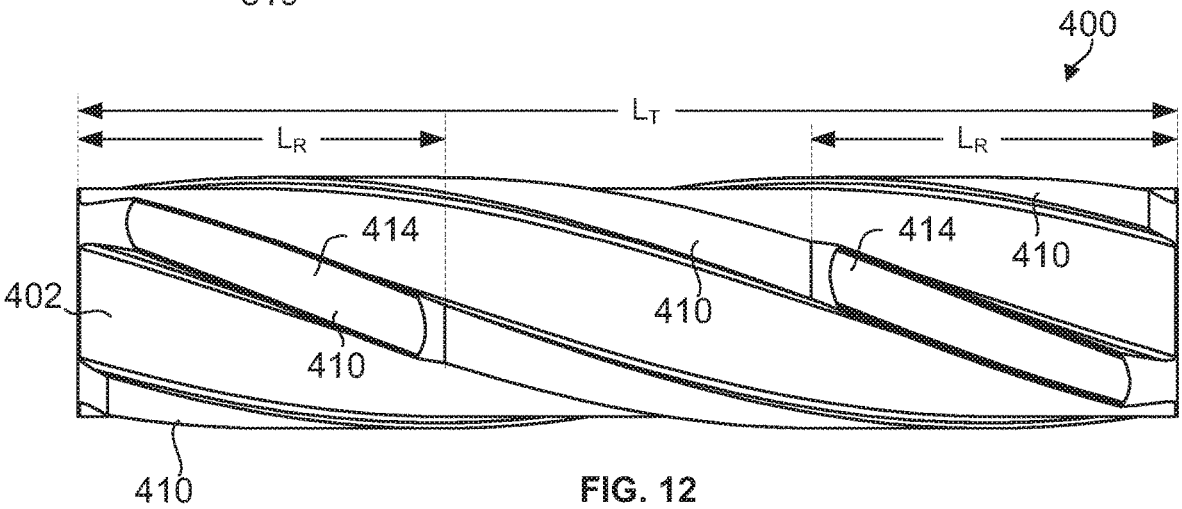
FIG. 12 is a side view of an example apparatus according to still another embodiment.

The length of the apparatus may also vary as shown in Table 1 above. As mentioned above, the example apparatus 100 in FIGS. 1 to 8 has a total length of approximately 12 inches. FIGS. 11 and 12 illustrate some other example lengths.

FIG. 11 is a side view of an apparatus 300 (similar to the apparatus 100 in FIGS. 1 to 8) according to some embodiments. The apparatus 300 includes a tubular segment 302 and spaced apart helical ridges 310 (arranged in an alternating manner). Each ridge 310 revolves or spirals around more than ¼ of the circumference of the tubular segment 302. The tubular segment 302 has a total length ($L_T$) of approximately 17 inches. The axial length ($L_R$) of the raised portions 314 of the ridges 310 is approximately 6.5 inches.

FIG. 12 is a side view of another apparatus 400 (similar to the apparatus 100 in FIGS. 1 to 8) according to some embodiments. The apparatus 400 includes a tubular segment 402 and four spaced apart helical ridges 410 (arranged in an alternating manner). Each ridge 410 revolves or spirals around approximately ½ of the circumference of the tubular segment 402. The tubular segment 402 has a total length ($L_T$) of approximately 24 inches. The axial length ($L_R$) of the raised portions 414 of the ridges 410 is approximately 8 inches.

Turning again briefly to FIG. 8, in that example, the outward facing surface 122 of the raised section 114*b* forms a shallow groove 134 (similar to an ice skate blade). The remaining ridges 110*a* and 110*b* shown in FIG. 1 include similar grooves in their raised portions 114*a* and 114*b*, but the lower portions 112*a* and 112*b* do not define such grooves in that example. In other embodiments, such grooves may extend along the lower (non-raised) portions of the ridges as well. In still other embodiments, ridges may not include any such grooves.

Figure 13A:
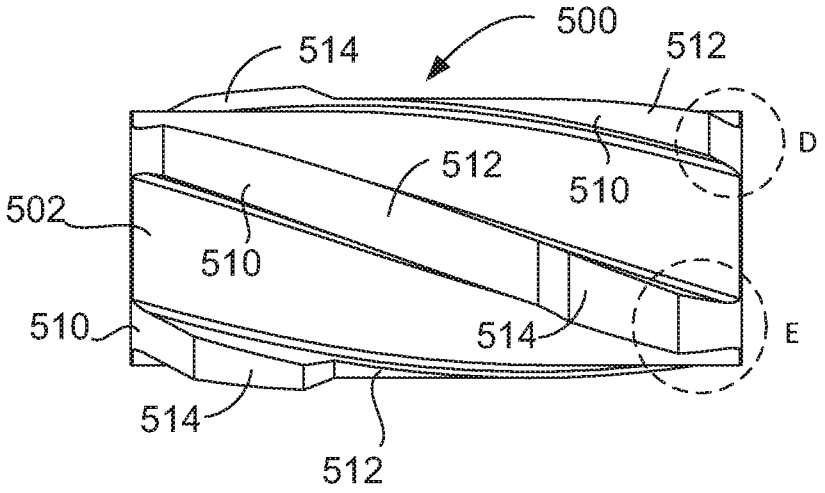
FIG. 13A is a side view of an example apparatus according to another embodiment.

FIG. 13A is a side view of another example apparatus 500 for mounting on a tubular structure (e.g. casing, drill string and/or tubular coil string, a completions string, and a well servicing string, etc.). The apparatus 500 includes a tubular segment 502 and four spaced apart helical ridges 510 (arranged in an alternating manner). Each ridge 510 includes a respective lower section 512 and a respective raised section 514.

Figure 13B:
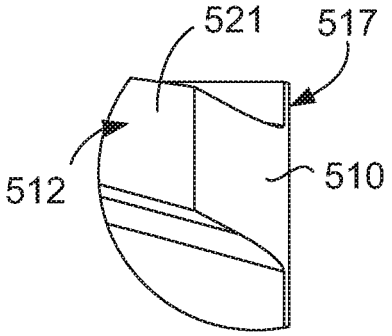
FIG. 13B is an enlarged partial view of the portion of the apparatus of FIG. 13A within the circle marked "D"

FIG. 13B is an enlarged partial view of the portion of the apparatus 500 within the circle marked "D" in FIG. 13A. As seen in FIG. 13B, the lower section includes an outward facing surface 521 that is substantially flat with no groove.

Figure 13C:
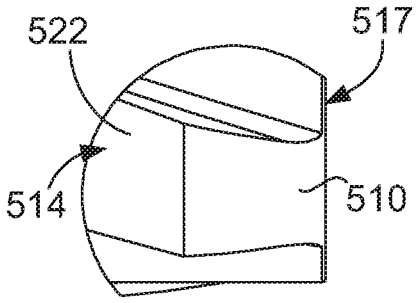
FIG. 13C is an enlarged partial view of the portion of the apparatus of FIG. 13A within the circle marked "E"

FIG. 13C is an enlarged partial view of the portion of the apparatus 500 within the circle marked "E" in FIG. 13A. As seen in FIG. 13C, the lower section includes an outward facing surface 522 that is also substantially flat with no groove. Thus, the ridges 510 in this example do not define an outward facing groove. FIGS. 13B and 13C also show that the ridges 510 are chamfered to be flush with the chamfer 517 of the tubular segment 502.

In other embodiments, the outward facing surfaces of the ridges may curve slightly along the width of the ridges to be substantially parallel with the circumference of the tubular segment. As also mentioned above, in other embodiments, both the lower and raised sections of the ridges may define grooves along their length.

Figure 14A:
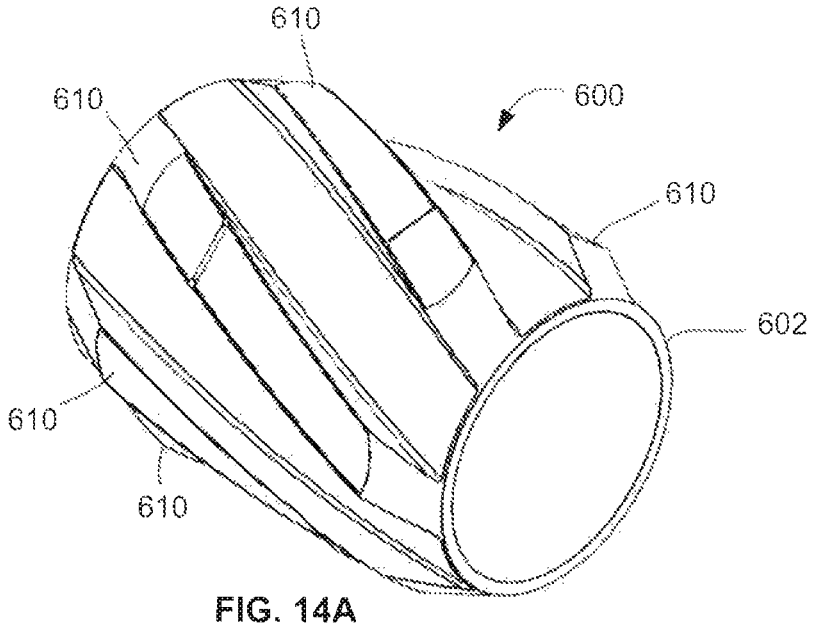
FIG. 14A is a perspective view of an example apparatus according to another embodiment.

The number of ridges also varies in other embodiments. For example, rather than four ridges, more or fewer ridges may be present. FIG. 14A is a perspective view of an apparatus 600 (similar to the apparatus 100 in FIGS. 1 to 8) according to yet another embodiment. This embodiment may be particularly suited to applications requiring standoff between the casing (or other tubular structure) and the wellbore wall. Standoff may be required for cementing and/or completion operations.

The apparatus 600 includes a tubular segment 602 and six (rather than four) spaced apart helical ridges 610 arranged in an alternating manner. The ridges 610 each rotate around approximately ⅙ of the outer circumference of the tubular segment 602.

Figure 14B:
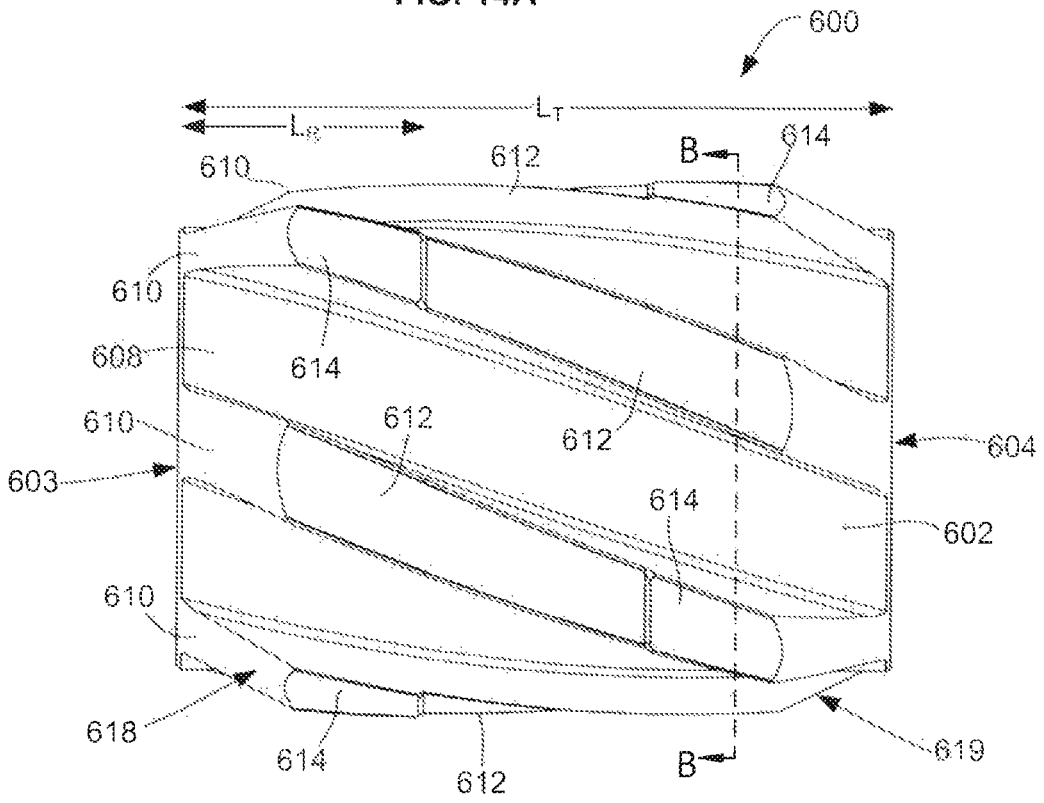
FIG. 14B is a side view of the apparatus of FIG. 14A.

FIG. 14B is a side view of the apparatus 600 of FIG. 14A. Each ridge 610 in FIG. 14B includes a respective lower section 612 and a respective raised section 614 (similar to ridges 110 of the apparatus 100 in FIG. 1). The ridges 610 are arranged on and extend outward from the outer face 608 of the tubular segment 602. Each ridge includes first and second opposite chamfered ends 618 and 619 that are flush with the ends 603 and 604 of the tubular segment 602. The angle of the chamfer is approximately 67.5 degrees with respect to the radial direction in this example. The total length $L_T$ of the apparatus 600 is approximately 12 inches, and the axial length $L_R$ of the raised sections 614 (starting at either end 603 or 604 of the apparatus) is approximately 4.15 inches in this example. The length $L_R$ may range, for example, from one quarter to one half of the total length $L_T$ of the apparatus 600, although embodiments are not limited to this range.

Both the lower and raised sections 612 and 614 of the ridges 610 are grooved (similar to the blade of an ice skate) in this embodiment.

Figure 14C:
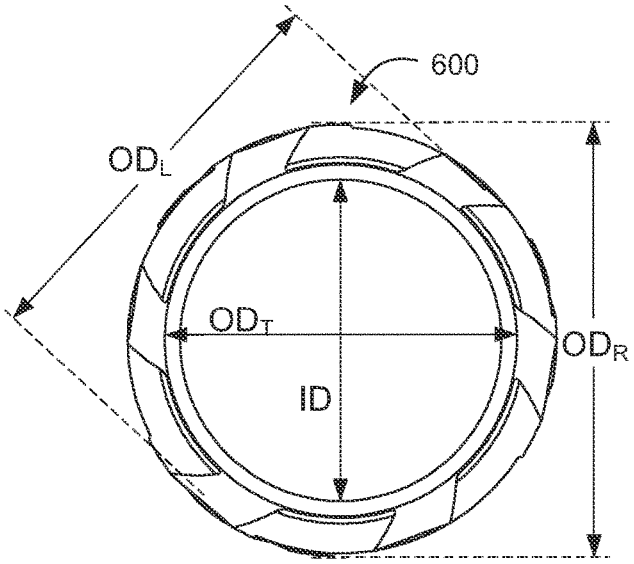
FIG. 14C is an end view of the apparatus of FIGS. 14A and 14B.

FIG. 14C is an end view of the apparatus 600 for mounting on a tubular structure (e.g. casing, drill string and/or tubular coil, etc.). FIG. 14C shows the inner diameter (ID) of the tubular segment 602, which is approximately 6.7 inches in this example. The outer diameter ($OD_T$) of the tubular segment 602 is also shown, which is approximately 7.4 inches in this example. The outer diameter ($OD_R$) of the apparatus at the raised sections 614 of the ridges 610 (see FIG. 14D) is approximately 9.0 inches in this example. The outer diameter ($OD_L$) at the lower sections 612 (see FIG. 14D) is approximately 8.875 inches (only ⅛ of an inch less than at the raised sections). Thus, the raised sections 614 and lower sections 612 of the ridges 610 are close to the same height in this example, but the height difference may still induce sufficient intermittent raising and lowering of the apparatus 600 and tubular structure (e.g. casing or drill string, or coiled tubing, etc.) to reduce or mitigate friction, while possibly providing sufficient standoff for various well operations.

Figure 14D:
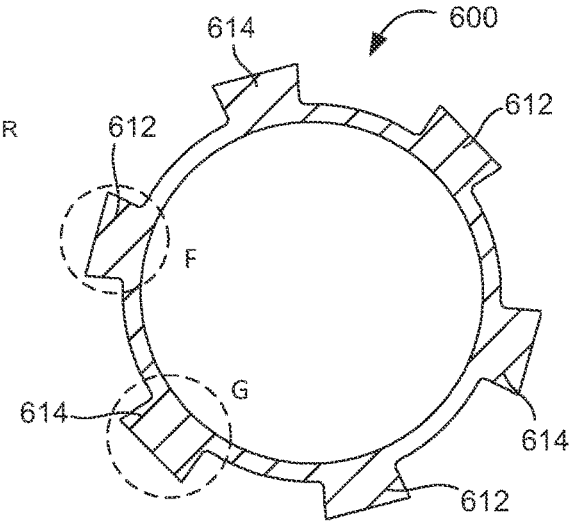
FIG. 14D is a cross-sectional view of the apparatus of FIG. 14B taken along the line "B"

FIG. 14D is a cross-sectional view of the apparatus 600 taken along the line "B" in FIG. 14A. Thus, the line alternately intersects lower sections 612 and raised sections 614 of the ridges 610.

Figure 14E:
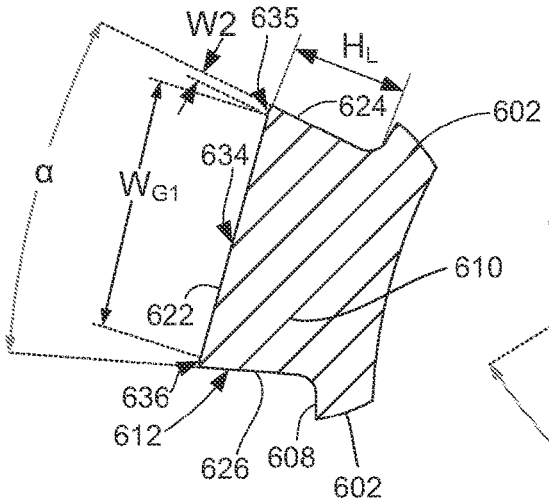
FIG. 14E is an enlarged partial view of the portion of the apparatus of FIG. 14D within the circle marked "F"

FIG. 14E is an enlarged partial view of the portion of the apparatus 600 within circle "F" in FIG. 14D. FIG. 14E shows a lower section 612 of one of the ridges 610. As shown, the lower section 612 extends a height $H_L$ from the outer face 608 of the tubular segment 602. In this example, $H_L$ is approximately 0.74 inches (although $H_L$ will vary in other embodiments). The side walls 624 and 626 of the ridge 610 are at an angle $\alpha$ to one another. The angle $\alpha$ is approximately 22 degrees in this example, although other angles may be used in other embodiments. In other embodiments, the angle $\alpha$ may be in the range of approximately 15 to 40 degrees (e.g. 15, 20, 30 degrees or more), although embodiments are not limited to this range.

An outward facing surface 622 of the lower section 612 in this example defines a wide, shallow groove 634 with a width $W_{G1}$ of approximately 1.57 inches. The groove 634 in this example has a depth of approximately 0.005 inches, although other depths may also be used (e.g. 0.01 to 0.05 inches or more). The groove is almost as wide as the surface 622, but leaves non-grooved portions 635 and 636 adjacent the side walls 624 and 626. The non-grooved portions 635 and 636 are each approximately 0.063 inches wide in this embodiment.

Figure 14F:
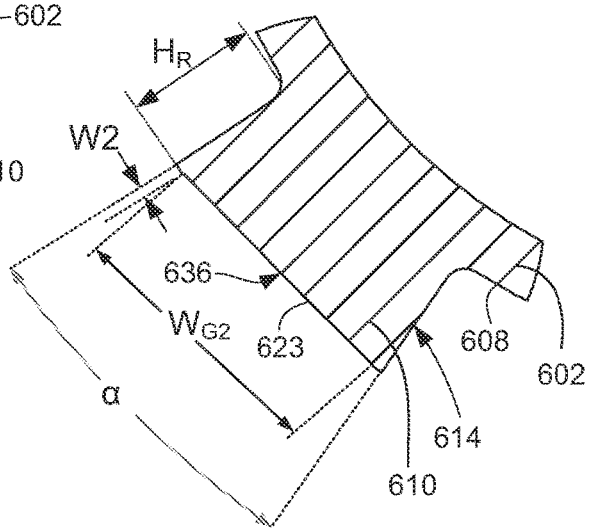
FIG. 14F is an enlarged partial view of the portion of the apparatus of FIG. 14D within the circle marked "G"

FIG. 14F is an enlarged partial view of the portion of the apparatus 600 within circle "G" in FIG. 14D showing a raised section 614 of one of the ridges 610. As shown, the lower section 612 extends a height $H_R$ from the outer face 608 of the tubular segment 602. In this example, $H_R$ is approximately 0.8 inches (although $H_R$ will vary in other embodiments). The angle $\alpha$ (22 degrees) is also shown in FIG. 14F. The raised section 614 also has a slightly grooved or concave outward facing surface 623. The groove 636 has a width $W_{G2}$ that is approximately 1.59 inches and is about 0.005 inches deep. Thus, the groove 636 is slightly wider than the groove 634 of the lower section 612 shown in FIG. 14E.

Figure 15A:
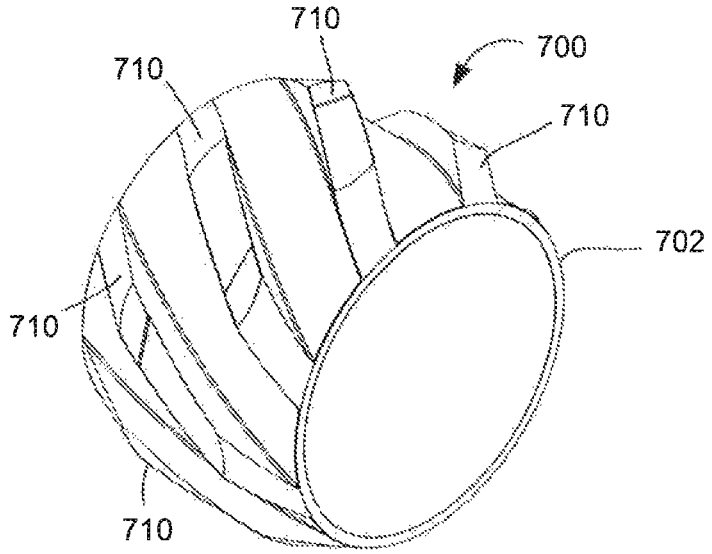
FIG. 15A is a perspective view of an example apparatus according to another embodiment.
Figure 15B:
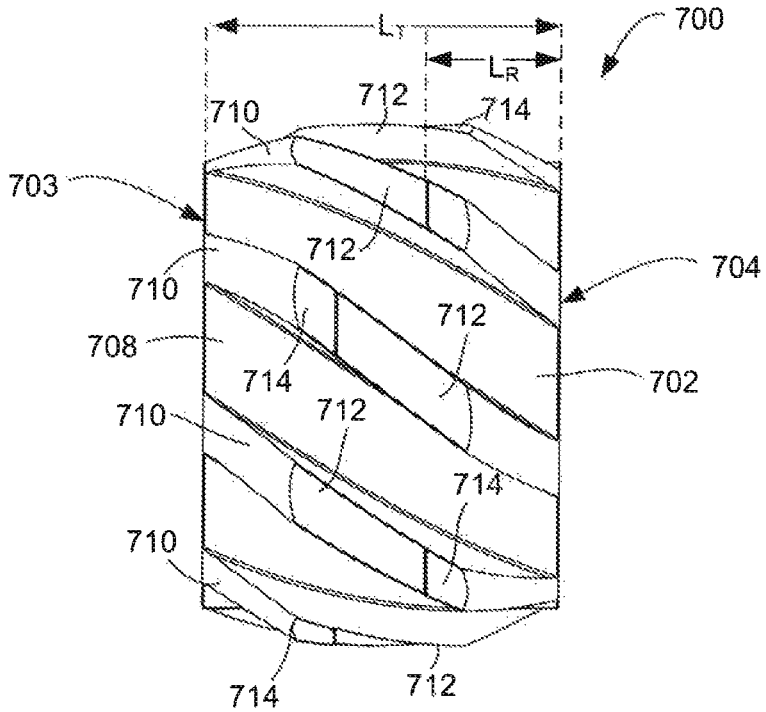
FIG. 15B is a side view of the apparatus of FIG. 15A.

FIG. 15A is a perspective view of an apparatus 700 for mounting on a tubular structure (e.g. casing, drill string and/or tubular coil, etc.) according to yet another embodiment. The apparatus 700 includes a tubular segment 702 and eight spaced apart helical ridges 710 thereon, arranged in an alternating manner. The ridges 710 each rotate around approximately ⅛ of the outer circumference of the tubular segment 702. FIG. 15B is a side view of the apparatus 700 of FIG. 15A. Similar to the ridges in other embodiments described herein, each ridge 710 in FIG. 15B includes a respective lower section 712 and a respective raised section 714. The ridges 710 extend outward from the outer face 708 of the tubular segment 702. In this example, the tubular segment 702 has an inner diameter of approximately 18.7 inches. The ridges each have a height of about 1.83 inches at their lower sections 712 and about 1.9 inches at their raised sections 714. This embodiment may, again, be suited to applications requiring a particular standoff due to the relatively small height difference between the lower sections 712 and the raised sections 714. Ridges 710 may be approximately 3 inches wide. The lower and upper sections 712 and 714 for each ridge 710 are each slightly grooved (similar to the outer surfaces 622 and 623 of the grooves 610 in FIGS. 14E and 14F) respectively. The total length $L_T$ of the apparatus 700 is approximately 16 inches, and the length $L_R$ of the raised sections 714 (starting at either end 703 or 704 of the apparatus 700) is approximately 6 inches in this example. As discussed and shown in table 1 above, the actual dimensions of the tubular segment 702 and ridges 710 may vary. The angle between side walls of the ridges 710 in this embodiment is approximately 15 degrees. As seen in FIG. 15B, the ridges 710 are chamfered at the ends 703 and 704 of the apparatus. The length of the chamfering/tapering depends on the height of the ridges 710 and the angle of the chamfer. In this example, the angle is approximately 67.5 degrees. The height of the ridges is also chamfered between the lower section 712 and the raised section 714.

Figure 16:
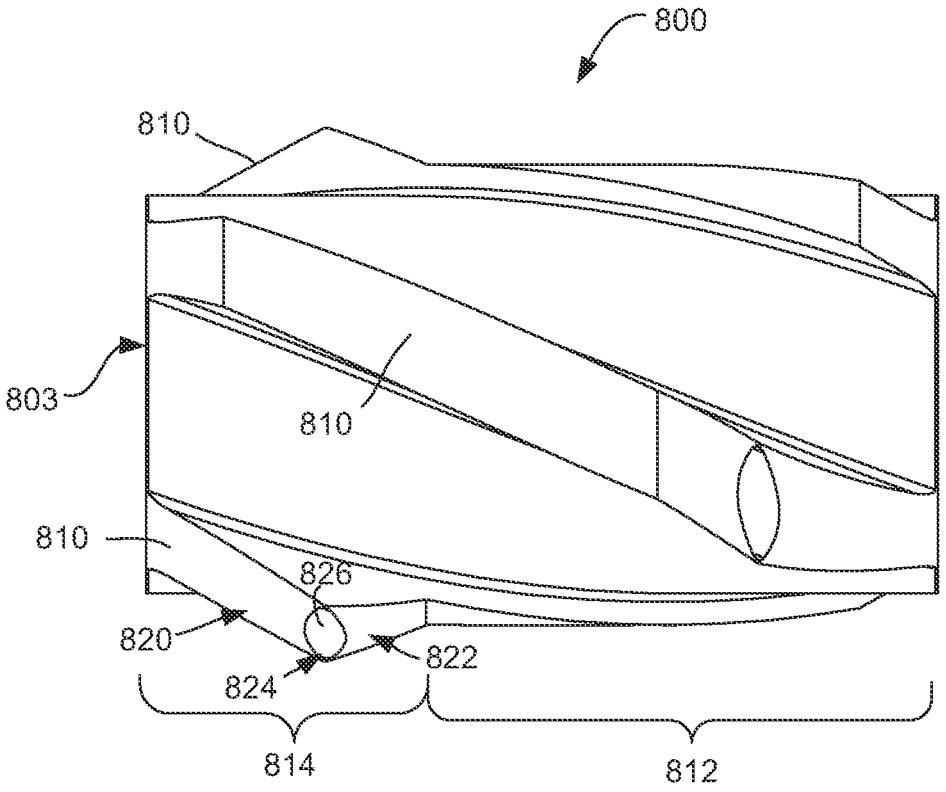
FIG. 16 is a side view of an example apparatus according to yet another embodiment.

FIG. 16 shows still another example apparatus 800 for mounting on a tubular structure (e.g. casing, drill string and/or tubular coil). The dimensions of this apparatus 800 may conform to "Example 9" shown in Table 1 above. As indicated for one of the ridges 810, the ridge includes a lower section 812 and a raised section 814. The raised section 814 includes first and second beveled or chamfered sections 820 and 822. The first chamfered section 820 tapers from the full height of the raised section 814 to the first end 803 of the tubular segment 800. The second chamfered section 822 chamfers (in the opposite direction) to the height of the lower section 812. The second chamfered section 822 ends where the lower section 812 begins. The height of the raised section 814 and angle of the chamfering is such that the first and second chamfered sections 820 and 822 form the majority of the raised section 814 and meet (or nearly meet) at peak 824. The peak 824 comprises an outward facing surface 826. The outward facing surface 826 is slightly grooved or concave similar to other examples described above. The remaining ridges 810 have a similar structure, but are arranged in an alternating manner.

In some embodiments, the tubular segment and ridges/blades of the apparatus comprise two or more pieces or portions that may be coupled together and decoupled or disassembled. For example, the tubular segment and ridges may be divided into two or more pieces that may be assembled around a tubular structure (e.g. casing section). Thus, in the case of a casing string, the apparatus may not need to be placed over an end of the casing string section and may be mounted to a section of casing string section that is already coupled to other sections. Any suitable method to join or couple multiple pieces of the apparatus together may be used.

Figure 17:
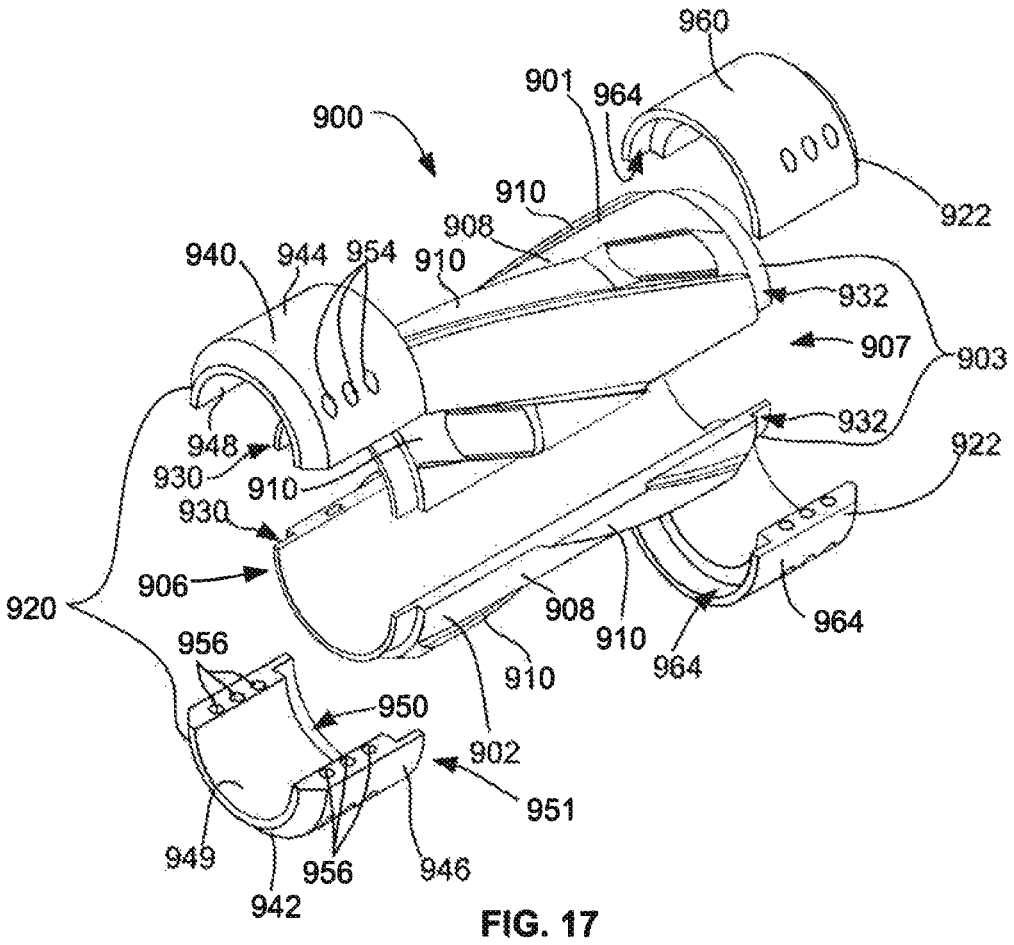
FIG. 17 is an exploded perspective view of an example apparatus according to still another embodiment.

FIG. 17 is an exploded perspective view of an example apparatus 900 for mounting on a tubular structure (e.g. casing, drill string and/or tubular coil) according to yet another embodiment. The apparatus 900 includes a first semi-tubular piece 901 and a second semi-tubular piece 902 that can be coupled together and decoupled. The first and second pieces 901 and 902 together form a tubular segment 903 with ridges 910 thereon (similar to the apparatus 100 in FIG. 1). The tubular segment 903 and ridges 910 in this example are bisected along their length to form the first and second semi-tubular pieces 901 and 902. The first and second pieces 901 and 902 can be placed around a tubular structure (not shown) and coupled together.

The apparatus 900 in FIG. 17 also includes first and second clamps 920 and 922 that hold the first and second semi-tubular pieces 901 and 902 together. The tubular segment 903 (formed by the first and second semi-tubular pieces 901 and 902) has first and second ends 906 and 907 and an outer face 908. The outer face defines first and second annular, outer rabbet-type recesses 930 and 932 at the first and second ends 906 and 907, respectively.

The first clamp 920 comprises first and second semi-tubular pieces 940 and 942, each having a respective outer face 944 and 946 and a respective inner surface 948 and 949. The inner surfaces 948 and 949 collectively define an annular, inner rabbet-type recess 950 at one end 951 of the clamp 920. The first clamp 920 is sized such that its inner rabbet-type recess 950 fits over and engages the outer rabbet-type recesses 930 of at the first end 906 of the tubular segment 903. The first clamp 920 has inner and outer diameters that match the tubular segment. The first clamp 920 in this example include holes 954 and 956 for receiving fastening hardware (not shown) such as screws, bolts, etc. to fasten the first and second pieces 940 and 942 of the clamp 920 together.

The second clamp 922 is structurally similar or the same as the first clamp 920 and includes first and second pieces 960 and 962 defining inner rabbet-type recess 964 for engaging the outer rabbet-type recesses 932 of at the second end 907 of the tubular segment 903.

Figure 18:
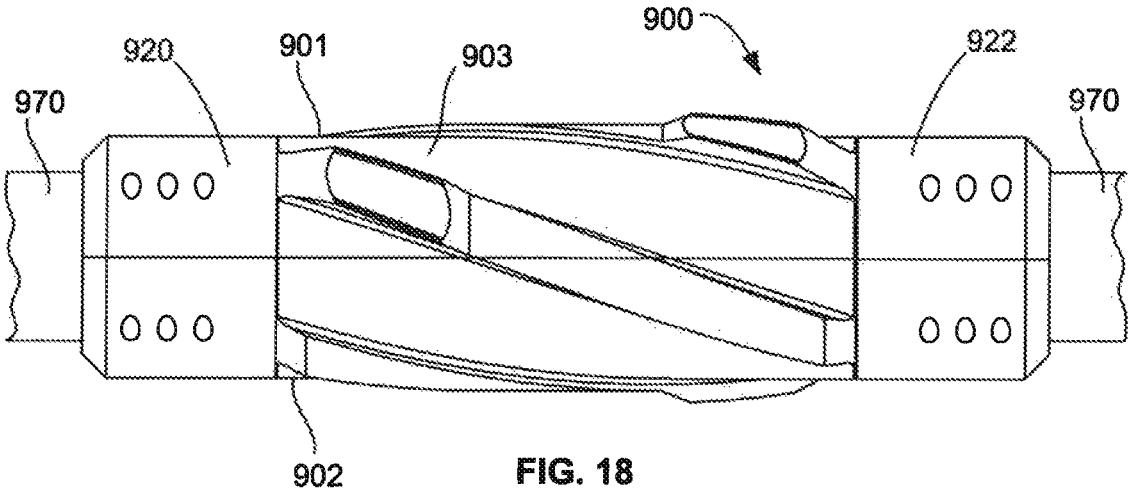
FIG. 18 is a side view of the apparatus of FIG. 17 mounted on a casing section.

FIG. 18 is a side view of the apparatus 900 of FIG. 17. In FIG. 18, the first and second clamps 920 and 922 have engaged and coupled the first and second pieces 901 and 902 of the tubular segment 903. The apparatus is mounted to a casing section 970. The apparatus 900 may also be decoupled for removal from the casing section 970 (or from another tubular structure).

Other clamp styles may also be utilized. In other embodiments other coupling hardware may be utilized including but not limited to clips, welding, adhesives, hinges, or other fastening hardware. Embodiments are not limited to any particular method of coupling and decoupling pieces of the apparatus.

In other embodiments, the apparatus may comprise more than two pieces that can be coupled together to form the tubular segment and ridges.

Figure 19:
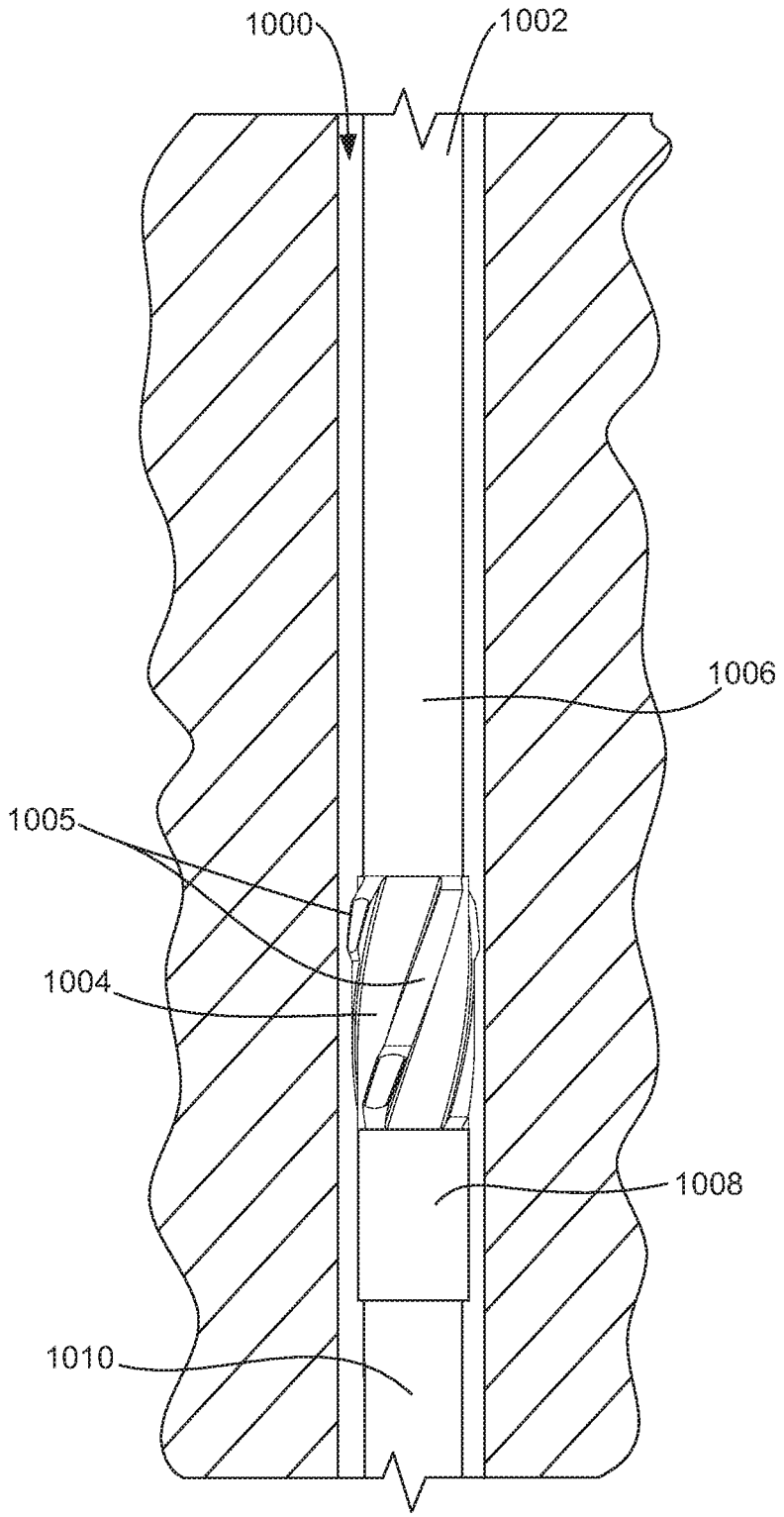
FIG. 19 is a partial side cross-sectional view of a wellbore with a casing string therein, the casing string having an apparatus according to one embodiment mounted thereon.

FIG. 19 is a partial side cross-sectional view of a wellbore 1000 with a casing string 1002 therein. A downhole apparatus 1004 (similar to the apparatus 100 in FIG. 1) is mounted on the casing string. The apparatus includes ridges 1005 that are similar to the ridges 110*a* and 110*b* in FIG. 1. In this example, the apparatus 1004 is installed without using stop collars. Specifically, the apparatus is installed on a first casing section 1006 over a first coupler 1008 that couples the first casing section 1006 to a second casing section 1010 below it. The apparatus 1004 can slide and rotate freely on the first casing section 1006. In FIG. 19, the wellbore 1000 is vertical and wide enough that the apparatus 1004 is not yet encountering friction and, thus, sits on the first coupler 1008.

Figure 20:
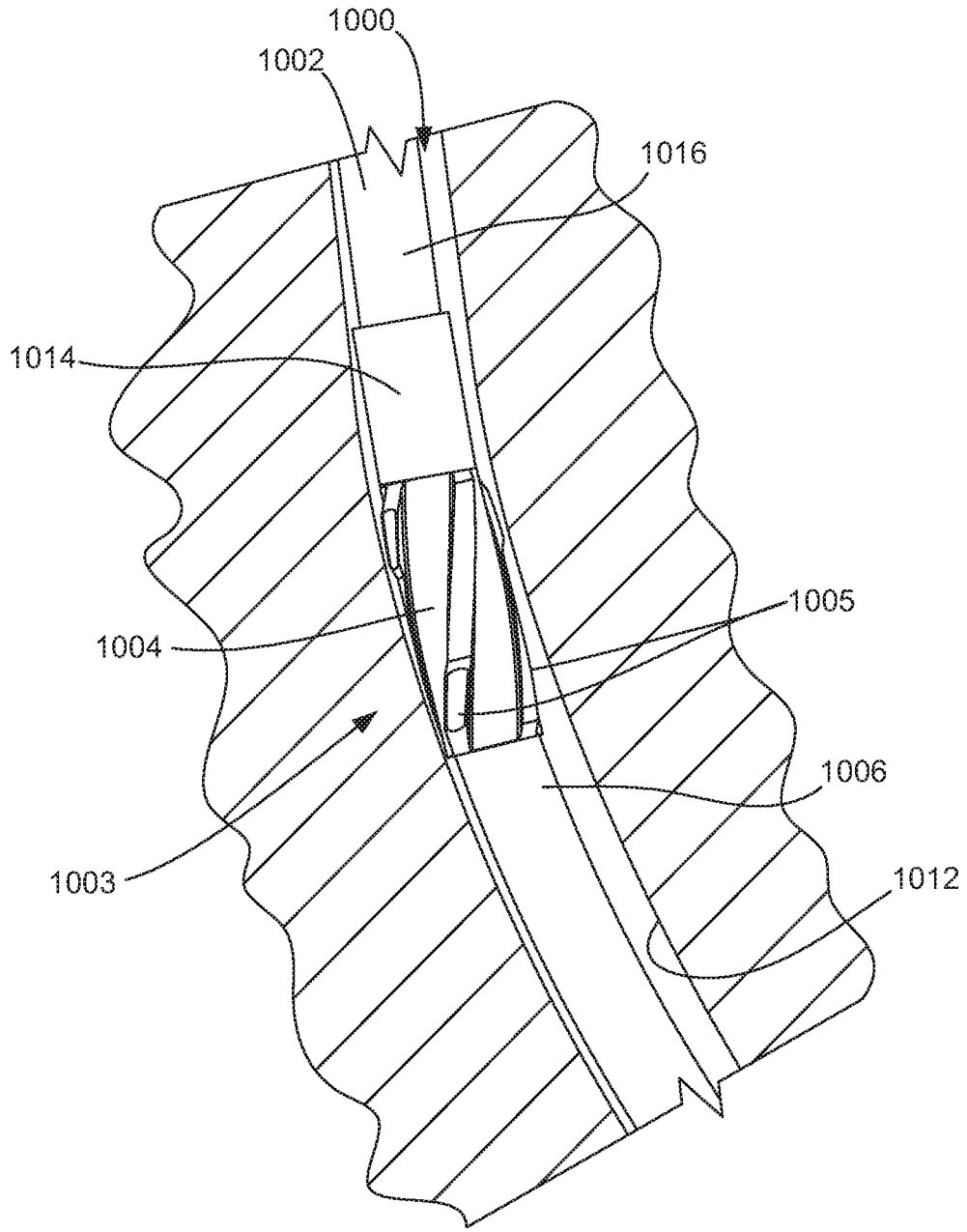
FIG. 20 is another partial side cross-sectional view of the wellbore, the casing string and the apparatus of FIG. 19.

FIG. 20 is a partial side cross-sectional view of a wellbore 1000 with a casing string 1002 therein, but within the build section 1003 of the wellbore. As the first casing section 1008 (shown in FIG. 19) carrying the apparatus 1004 reaches the build section, the apparatus 1004 encounters friction from the surface 1012 of the wellbore. Initially, when encountering friction, the apparatus 1004 may initially remain static while the first casing section 1006 continues to move forward, until the apparatus 1004 comes into contact with a second coupling 1014 above it. The second coupling 1014 couples the first casing section 1006 and a third casing section 1016 (which is above the first casing section 1006). The second coupling 1014 may then push the apparatus 1004 through the wellbore 1000. The friction of the ridges 1005 moving against the wellbore surface 1012 may cause the apparatus 1004 to rotate as discussed above. In this example, the rotation will be similar to the rotation shown in FIGS. 9A to 9D. This rotation may cause intermittent lifting and lowering, thereby mitigating friction. The rotation rate of the apparatus 1004 may depend on the run speed of the casing string.

The apparatus 1004 may alternatively encounter friction and begin rotation while still in the vertical portion of the wellbore 1000 (shown in FIG. 19)

Since the apparatus 1004 may rotate independently of the casing string, the casing string may be circulated and/or rotated while the apparatus 1004 continues to rotate. Excessive torque on the casing string couplings may be minimized.

As the casing string 1002 extends further into the horizontal section of the wellbore (not shown), the vertical force applied on the casing string 1002 may increase throughout the build section, where the risk of tubular buckling may be highest. The friction mitigation provided by the apparatus 1004 may reduce axial tension throughout the build section 1003, thereby mitigating tubular buckling.

It is to be understood that the figures described above are provided for illustrative purposes, and the curvature and dimensions shown therein are not necessarily to scale.

The embodiments of the apparatus described herein may be used, for example, in wells that are intended to be cemented. However, some embodiments may be used in wells that are not to be cemented. The apparatus may be suitable for wells of various types and in various different well environments. Embodiments are not limited to a particular type of well. Similarly, embodiments are not limited to use in build and horizontal sections of wells.

Figure 21A:
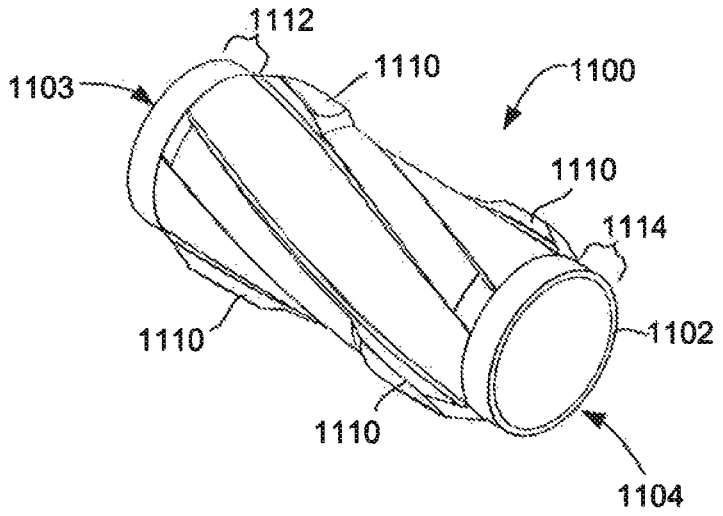
FIG. 21A is a perspective view of an example apparatus according to another embodiment.
Figure 21B:
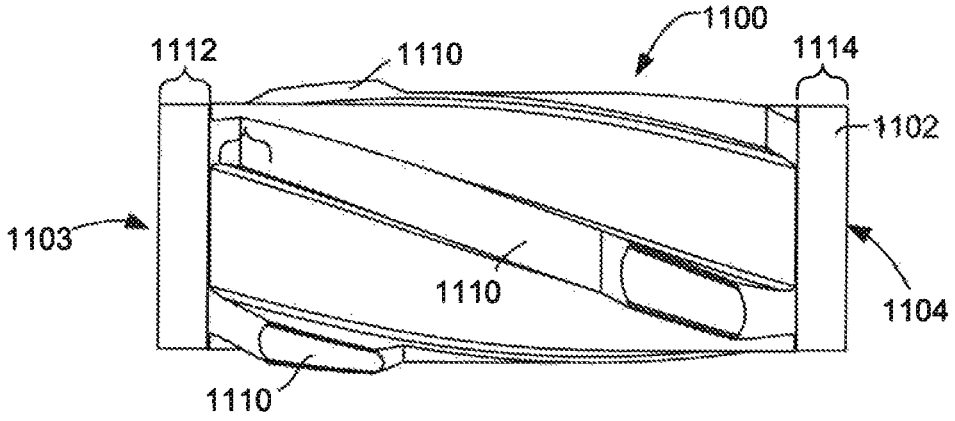
FIG. 21B is a side view of the apparatus of FIG. 21A.

FIG. 21A is a perspective view of an example apparatus 1100 for mounting on a tubular structure (e.g. casing, drill string and/or tubular coil) according to yet another embodiment. FIG. 21B is a side view of the apparatus 1100 of FIG. 21A. The apparatus 1100 includes a tubular segment 1102 (with first end 1103 and second end 1104) and ridges 1110 thereon similar to other embodiments described herein. The ridges 1110 in this example do not extend along the entire length of the tubular segment 1102. Instead, the apparatus 1100 has first and second runout portions 1112 and 1114 at the first and second ends 1103 and 1104 respectively. The ridges 1110 stop at the runout portions 1112 and 1114, not the first and second ends 1103 and 1104 of the tubular segment.

Figure 22A:
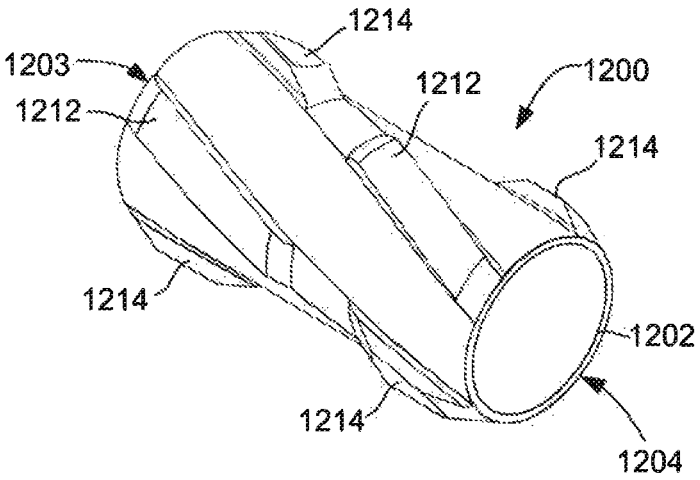
FIG. 22A is a perspective view of an example apparatus according to yet another embodiment.

FIG. 22A is a perspective view of an example apparatus 1200 for mounting on a tubular structure (e.g. casing, drill string and/or tubular coil) according to still another embodiment. FIG. 22B is a side view of the apparatus 1100 of FIG. 22A. The apparatus 1200 includes a tubular segment 1202 (with first end 1203 and second end 1204). In this example, rather than continuous spiral ridges with lower and raised sections, the apparatus 1200 includes a plurality of lower ridges 1212 and a plurality of raised ridges 1214. The ridges 1212 and 1214 are all angled from the axial direction in a generally right-handed manner from the first end 1203. In this example, each lower ridge 1212 is aligned (lengthwise) with a corresponding raised ridge 1214. The pairs of lower ridges 1212 and raised ridges 1214 are arranged in an alternating lengthwise orientation (similar to other embodiments described herein).

Figure 22C:
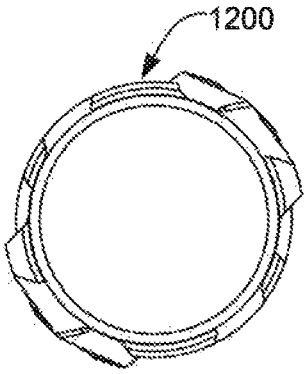
FIG. 22C is an end view of the apparatus of FIGS. 22A and 22B.
Figure 22B:
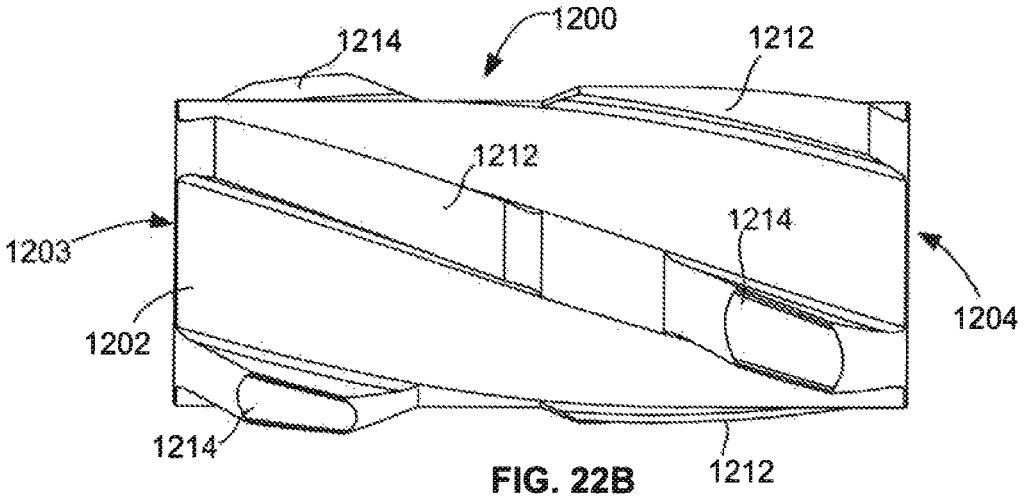
FIG. 22B is a side view of the apparatus of FIG. 22A.

FIG. 22C is an end view of the apparatus 1200. As shown, the arrangement of the lower ridges 1212 and the raised ridges 1214 provides a non-circular, more elliptical end profile. Thus, the apparatus, when rotating, may still intermittently raise and lower with respect to the wall of a hole (e.g. wellbore).

Figure 23A:
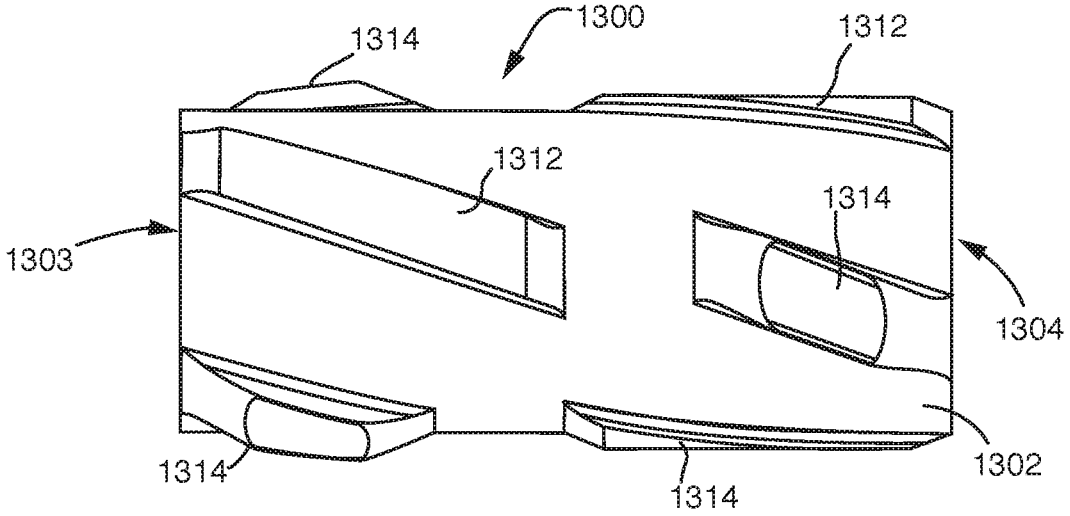
FIG. 23A is a side view of an example apparatus according to another embodiment.
Figure 23B:
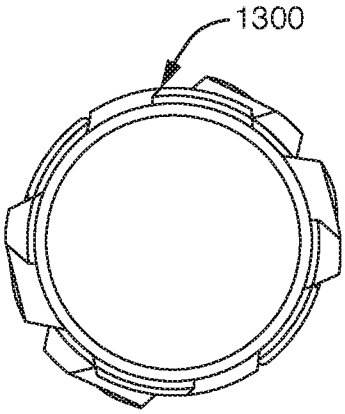
FIG. 23B is an end view of the apparatus of FIG. 23A.

FIG. 23A is a perspective view of an example apparatus 1300 for mounting on a tubular structure (e.g. casing, drill string and/or tubular coil) according to still another embodiment. FIG. 23B is a side view of the apparatus 1300 of FIG. 23A. The apparatus 1300 includes a tubular segment 1302 (with first end 1303 and second end 1304) and pluralities of lower ridges 1312 and raised ridges 1314 thereon. The ridges 1312 and 1314 are all angled similar to the apparatus 1200 in FIGS. 22A to 22C. However, in this example, the lower ridge 1312 are not aligned with the raised ridge 1314. Nevertheless, the ridges are still arranged to provide a non-circular end profile.

FIG. 23C is an end view of the apparatus 1300. As shown, the arrangement of the lower ridges 1312 and the raised ridges 1314 provides a non-circular, more elliptical end profile. Thus, the apparatus, when rotating, may still intermittently raise and lower with respect to the wall of a hole (e.g. wellbore).

Figure 24:
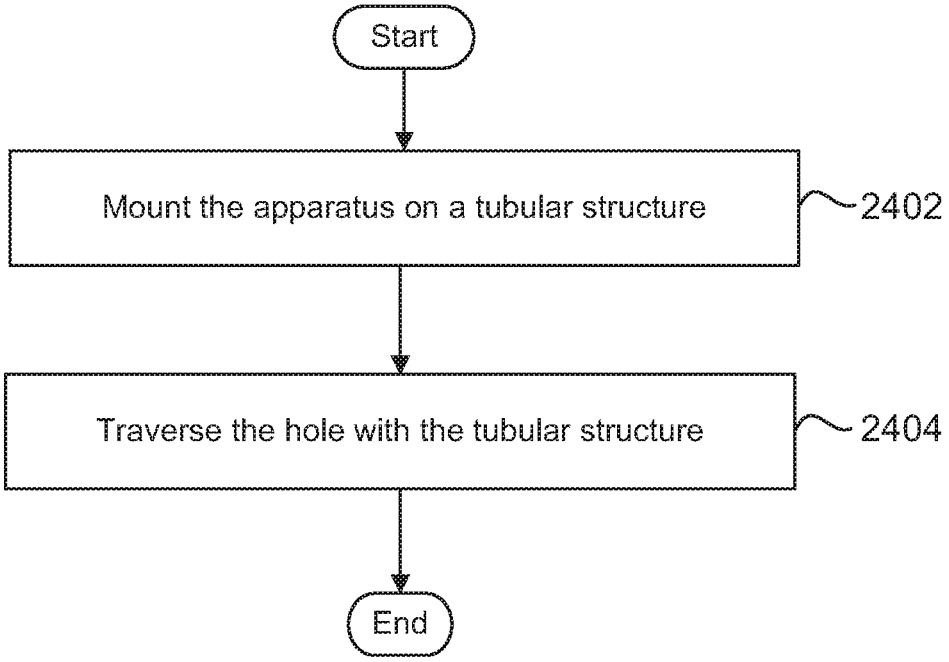
FIG. 24 is a flowchart of a method according to some embodiments.

According to some embodiments, a method for reducing friction in a well bore is provided. FIG. 24 is a flowchart of an example method. At block 2402, the apparatus (having a tubular segment and ridges thereon) as described herein is mounted on a tubular structure, such as a casing string, a drill string or coiled tubing. The tubular structure may be a casing or drill string, for example. At block 2404 the tubular structure, with the apparatus mounted thereon, traverses a hole. The hole may be a well wellbore, for example. Traversing the wellbore may include lowering the tubular structure into the wellbore. In some embodiments, mounting the apparatus (block 2402) may comprise placing the apparatus over an end of one of a plurality of sections of the tubular structure (e.g. a pin end of a casing section). In some embodiments, the apparatus comprises two or more pieces that couple together (such as the example in FIGS. 17 and 18). Thus, mounting the apparatus (block 2402) may comprise coupling the two or more portions about the tubular structure. The method may also include moving the apparatus, thus mounted, in a build or horizontal section of a well.

It is to be understood that a combination of more than one of the above approaches may be implemented in some embodiments. Embodiments are not limited to any particular one or more of the approaches, methods or apparatuses disclosed herein. One skilled in the art will appreciate that variations and alterations of the embodiments described herein may be made in various implementations without departing from the scope thereof. It is therefore to be understood that within the scope of the appended claims, the disclosure may be practiced otherwise than as specifically described herein.

What has been described is merely illustrative of the application of the principles of aspects of the disclosure. Other arrangements and methods can be implemented by those skilled in the art without departing from the scope of the claims.

What is claimed is:

1. An apparatus for mounting on a tubular structure for traversing a hole, the tubular structure having a longitudinal axis, the apparatus comprising:

a tubular segment comprising two or more portions couplable to form the tubular segment for mounting over the tubular structure such that the tubular segment is freely rotatable about the longitudinal axis, the tubular segment having an outer face that faces away from the tubular structure when mounted;

a plurality of ridges on the outer face of the tubular segment, the ridges being spaced apart and arranged around a circumference of the tubular segment and angled with respect to an axial direction of the tubular segment to induce rotation of the apparatus responsive to contact of the apparatus against a wall of a hole as the apparatus traverses the hole;

the ridges each having a non-uniform height with a lower section and a raised section relative to the outer face of the tubular segment, the raised section having a greater height than the lower section, the ridges alternating between having the raised section located at or near the first end of the tubular segment and at or near the second end of the tubular segment.

2. The apparatus of claim 1, wherein the non-uniform height of the ridges provides a non-circular end-view profile.

3. The apparatus of claim 1, wherein the plurality of ridges are angled a same direction from an axial direction to induce said rotation.

4. The apparatus of claim 1, wherein the ridges comprise helical or spiral ridges.

5. The apparatus of claim 4, wherein the ridges collectively extend around an entire circumference of the tubular segment.

6. The apparatus of claim 1, wherein the tubular segment has a first end and a second end opposite to the first end, and at least one of the ridges extend approximately from the first end to the second end.

7. The apparatus of claim 1, wherein the ridges comprise: two side walls extending outward from the outer face of the tubular segment; and an outward facing surface between the two sidewalls.

8. The apparatus of claim 7, wherein the outward facing surface of the ridges includes a recess or groove along at least a portion of a length of the ridge.

9. The apparatus of claim 1, wherein the apparatus is formed of one or more materials adapted for use in at least one of: an oil well; and a gas well.

10. The apparatus of claim 1, wherein the rotation of the apparatus and the non-uniform height of the ridges cause intermitted raising and lowering of the apparatus relative to the hole.

11. The apparatus of claim 1, wherein each said raised section extends along approximately one quarter to one half of the length of the tubular segment.

12. The apparatus of claim 1, wherein a width of each ridge of the plurality of ridges increases in a radial direction extending away from the outer face of the tubular segment.

13. The apparatus of claim 12, wherein at least one of the ridges has an isosceles-trapezoid-shaped cross-sectional profile.

14. The apparatus of claim 1, wherein the tubular segment defines an inner hole therethrough with an inner diameter that is larger than the outer diameter of the tubular structure.

15. The apparatus of claim 1, wherein the plurality of ridges comprises between four and eight ridges.

16. The apparatus of claim 1, wherein each said ridge has respective first and second ends, the first and second ends of the ridges being bevelled.

17. The apparatus of claim 1, wherein the two or more portions also being decouplable.

18. The apparatus of claim 17, wherein the two or more portions comprise a first semi-tubular portion and a second semi-tubular portion.

19. The apparatus of claim 18, further comprising one or more clamps for coupling the first and second semi-tubular portions.

20. The apparatus of claim 1, wherein the tubular structure is one of a casing string, a drill string, a well servicing string, a completions string, or a coiled tubing string.

21. The apparatus of claim 20, wherein the tubular structure is a casing string, and the inner diameter is larger than the outer diameter of a casing section of the casing string, but smaller than the outer diameter of a casing section coupler.

22. The apparatus of claim 1, wherein the hole is a wellbore.

23. A method comprising:

mounting the apparatus of claim 1 on a tubular structure;

traversing the hole with the tubular structure having the apparatus mounted thereon.

24. The method of claim 23, wherein the tubular structure comprises a section having an end, and mounting the apparatus on the tubular structure comprises placing the apparatus over the end of the section.

25. The method of claim 23, wherein mounting the apparatus on the tubular structure comprises coupling the two or more portions about the tubular structure.

* * * * *